US005168028A

United States Patent [19]

Nanya et al.

[11] Patent Number: 5,168,028

[45] Date of Patent: Dec. 1, 1992

[54] NEGATIVELY CHARGEABLE TONER FOR DEVELOPING LATENT ELECTROSTATIC IMAGES

[75] Inventors: Toshiki Nanya, Mishima; Masanori Suzuki, Numazu, both of Japan

[73] Assignee: Ricoh Company, Ltd., Tokyo, Japan

[21] Appl. No.: 607,311

[22] Filed: Oct. 31, 1990

[30] Foreign Application Priority Data

Nov. 2, 1989 [JP] Japan ..... 1-286729
May 24, 1990 [JP] Japan ..... 2-134857

[51] Int. Cl.[5] ..... G03G 9/00
[52] U.S. Cl. ..... 430/110; 430/109
[58] Field of Search ..... 430/109, 110

[56] References Cited

U.S. PATENT DOCUMENTS 3,723,512 3/1973 Niederprum et al. ..... 502/113
4,590,141 5/1986 Aoki et al. ..... 430/110 X
4,939,059 7/1990 Kawabe et al. ..... 430/99

FOREIGN PATENT DOCUMENTS 61-071830 4/1986 Japan .

*Primary Examiner*—Marion E. McCamish
*Assistant Examiner*—Stephen Crossan
*Attorney, Agent, or Firm*—Cooper & Dunham

[57] ABSTRACT

A negatively chargeable toner for developing latent electrostatic images comprising a binder resin, a coloring agent and a charge controlling agent which comprises a fluorine-containing quaternary ammonium salt of formula (I):

(I)

wherein X represents —$SO_2$ or —CO; $R_1$, $R_2$, $R_3$ and $R_4$ independently represent hydrogen, an alkyl group having 1 to 10 carbon atoms or an aryl group; m is an integer of 1 to 5; and n is an integer of 1 to 10.

10 Claims, 1 Drawing Sheet

FIGURE
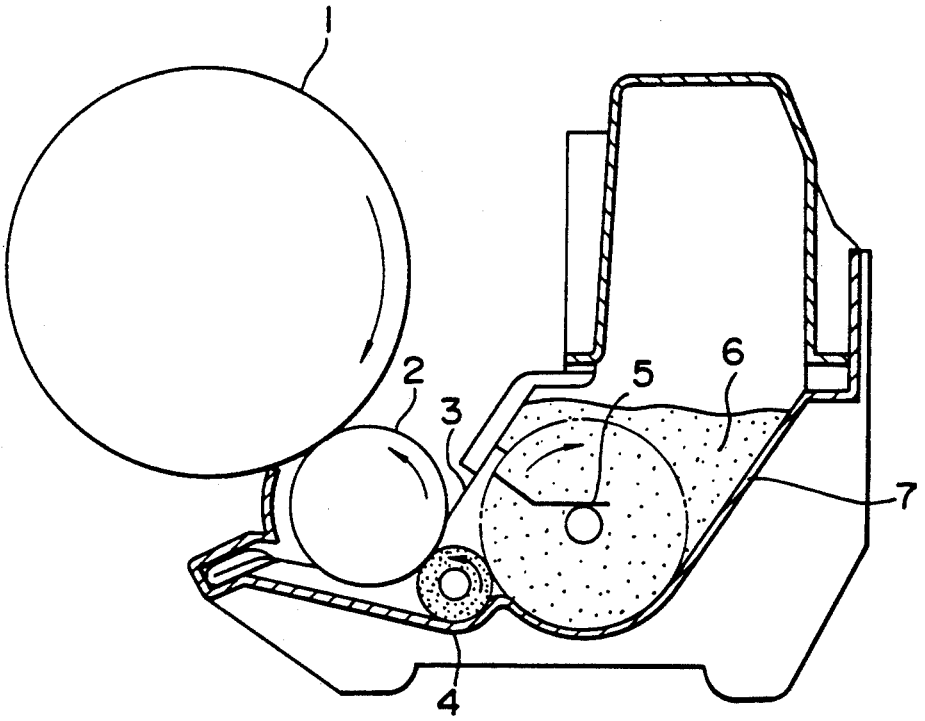

NEGATIVELY CHARGEABLE TONER FOR DEVELOPING LATENT ELECTROSTATIC IMAGES

BACKGROUND OF THE INVENTION

1. Field of the Invention

The present invention relates to a negatively chargeable toner for developing latent electrostatic images, and more particularly to a negatively chargeable toner comprising a binder resin, a coloring agent and a negative charge controlling agent.

2. Discussion of Background

For developing latent electrostatic images to visible toner images with a dry-type developer (toner), either a one-component dry-type developer or two-component dry-type developer is conventionally employed as disclosed in Japanese Laid-Open Patent Application 61-147261.

The one-component dry-type developer comprises a toner, while the two-component dry-type developer comprises a mixture of a toner and carrier particles.

When the two-component dry-type developer is used for developing latent electrostatic images, the toner and the carrier are triboelectrically charged to opposite polarities by mixing them, and the charged toner is electrostatically attracted to the latent electrostatic images provided with a polarity opposite to that of the toner, so that the latent electrostatic images are developed to visible toner images.

For use with such a two-component type developer, several development methods are known depending on the kind of toner and carrier. For example, a magnetic brush development method of using a carrier of iron powder, a cascade development method of using a carrier of beads, and a fur brush development method are known.

In the case of the one-component dry-type developer, a powder cloud development of spraying toner particles in the air, a contact development (or touch-down development method) of bringing toner particles into contact with latent electrostatic images and an induction development method of bringing an electroconductive magnetic toner into contact with latent electrostatic images are used.

Toners for use in the above-mentioned various development methods are usually prepared by dispersing a coloring agent such as carbon black in a binder resin comprising a natural resin or synthetic resin and crushing the mixture. For example, a coloring agent is dispersed in a binder resin such as polystyrene and the mixture is pulverized until the particle diameter reaches about 1 to 30 μm. Moreover, a magnetic toner can be obtained by adding a magnetic material such as magnetite to the above-prepared toner.

The toners for use in the previously mentioned development methods are negatively or positively charged according to the polarity of the latent electrostatic images to be developed. In order to charge the toner particles, the triboelectric charging property of a resin component contained in the toner can be utilized. However, the desired chargeability cannot be always obtained by triboelectric charging of the resin component, so that fogging easily takes place in the obtained images, which makes the images unclear. Therefore, to impart the desired triboelectric chargeability to the toner, dyes or pigments which can impart such triboelectric chargeability to the toner or charge controlling agents are generally added to the toner.

Examples of the conventional charge controlling agents which apply a negative charge to the toner include metal complex salts of a monoazo dye, nitrohumic acid and salts thereof, Co, Cr and Fe complexes of salicylic acid, naphthoic acid and dicarboxylic acid, sulfonated copper phthalocyanine pigments, nitro group- or halogen-introduced styrene oligomers, chlorinated paraffin and melamime resin.

The structure of the above-mentioned charge controlling agents is complicated and the characteristics thereof are unstable. In addition, the above-mentioned charge controlling agents tend to be decomposed or changed by mechanical shocks, friction and changes in the ambient temperature and humidity when they are kneaded with other components under application of heat to prepare a toner. With many of the above charge controlling agents, the chargeability is susceptible to the changes in the environmental conditions.

Moreover, when the toner containing such a conventional charge controlling agent is used for an extended period of time, the toner particles are apt to be deposited on the surface of a photoconductor due to the improper charging thereof. As a result, a so-called toner-filming phenomenon takes place.

Recently, polyester resin and epoxy resin are usually employed as a binder resin for the toner because they do not adhere to a PVC film and not impair the original color of the toner, particularly in the case of a color toner.

However, when the polyester resin and epoxy resin are used as the binder resins, the charge quantity of the toner is insufficient or the charge quantity decreases while in use even if high charge quantity is initially obtained. This causes the fogging of images or scattering of the toner on a copy paper. This is because the functional groups contained in the polyester resin and epoxy resin, such as —COOH group and —OH group, hinder the electric charge from remaining on the toner particles.

In addition to the above, toners comprising a fluorine-containing compound have been proposed, for instance, in Japanese Laid-Open Patent Applications 53-124428, 55-5025, and 58-66950. More specifically, in Japanese Laid-Open Patent Application 53-124428, a particular aliphatic fluorocarbon or fluorochlorocarbon is employed, in Japanese Laid-Open Patent Application 55-50251, particular fluorine-containing compounds are employed, and in Japanese Laid-Open Patent Application 58-66950, a capsule-type toner which is surface-treated by an organic fluoro compound is proposed. However, these toners are not always satisfactory for use in practice.

SUMMARY OF THE INVENTION

Accordingly, an object of the present invention is to provide a negatively chargeable toner for developing latent electrostatic images, having stable triboelectric chargeability, which is obtained by the friction between toner particles, and between the toner particles and carrier particles, or in the case of the one-component type toner, by the friction between the toner particles and a charge-application member such as a development sleeve or blade, a sharp distribution of the charge quantity of the toner, quick triboelectric chargeability, controllability of charge quantity, depending upon a development system to be employed, and improved environmental stability.

Another object of the present invention is to provide a negatively chargeable toner capable of yielding clear color images.

A further object of the present invention is to provide a negatively chargeable toner capable of yielding high quality images with excellent fidelity, without scattering or deposition of toner particles on the background of a copy paper, even when used for an extended period of time.

The above-mentioned objects of the present invention can be achieved by a negatively chargeable toner for developing latent electrostatic images comprising (i) a binder resin, (ii) a coloring agent and (iii) a charge controlling agent which comprises a fluorine-containing quaternary ammonium salt represented by the following formula (I):

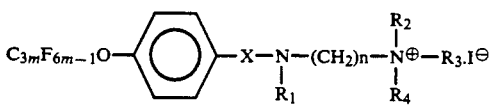

(I)

wherein X represents —$SO_2$ or —CO; $R_1$, $R_2$, $R_3$ and $R_4$ independently represent hydrogen, an alkyl group having 1 to 10 carbon atoms or an aryl group; m is an integer of 1 to 5; and n is an integer of 1 to 10.

BRIEF DESCRIPTION OF THE DRAWING

In the drawing, the single figure is a schematic cross-sectional view of a development unit for use in the present invention.

DESCRIPTION OF THE PREFERRED EMBODIMENTS

In the present invention, as the charge controlling agent, the fluorine-containing quaternary ammonium salt represented by the above described formula (I) is preferably used with a metal-containing azo dye.

Examples of the fluorine-containing quaternary ammonium salt of formula (I) for use in the present invention are as follows:

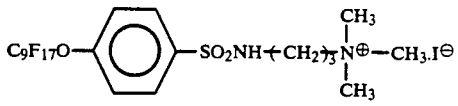

(1)

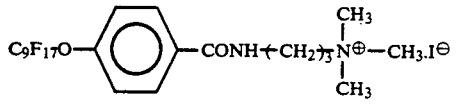

(2)

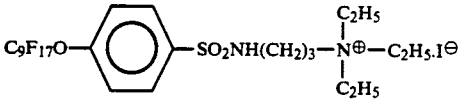

(3)

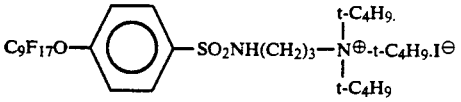

(4)

-continued

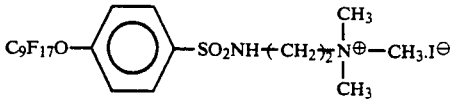

(5)

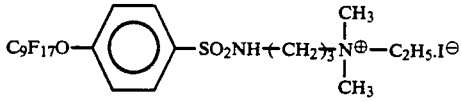

(6)

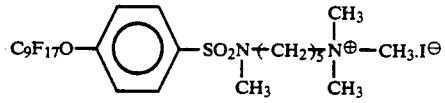

(7)

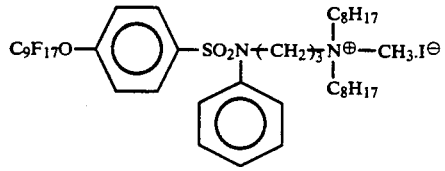

(8)

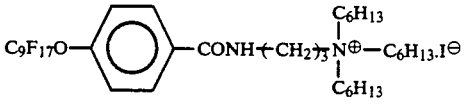

(9)

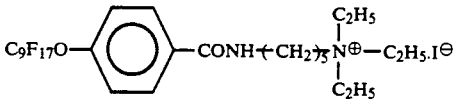

(10)

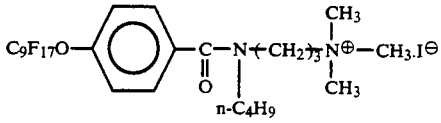

(11)

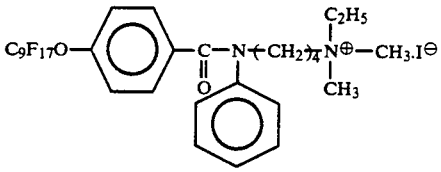

(12)

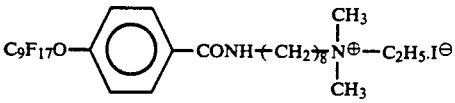

(13)

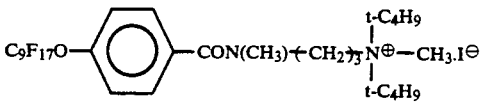

(14)

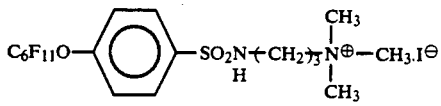

(15)

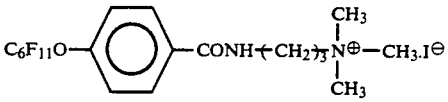

(16)

-continued (17)

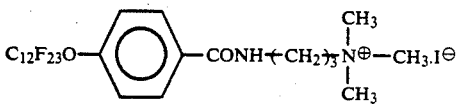

(18)

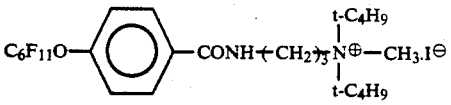

(19)

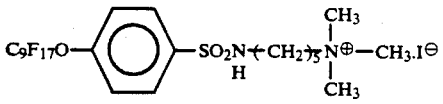

(20)

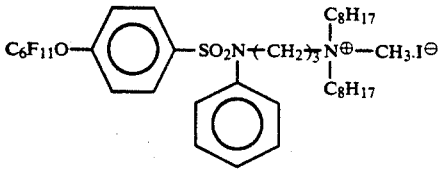

(21)

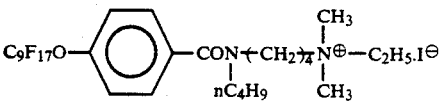

(22)

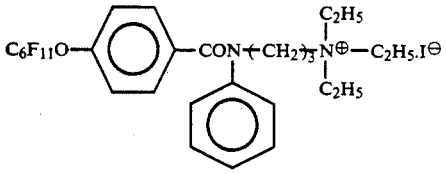

(23)

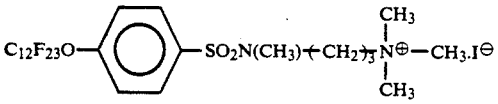

(24)

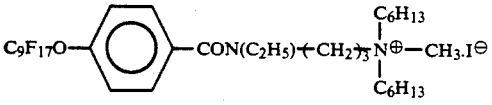

(25)

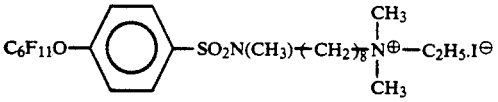

(26)

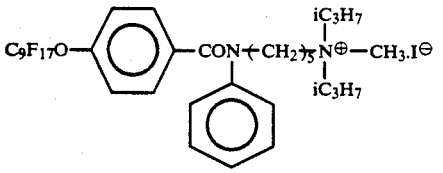

(27)

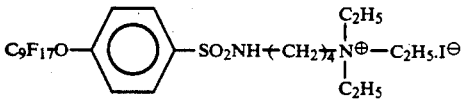

The above fluorine-containing quaternary ammonium salts (1) to (27) for use in the present invention are white or light-yellow in color.

The amount of the fluorine-containing quaternary ammonium salt serving as a charge controlling agent is determined by (i) the kind of binder resin employed, (ii) the presence of additives and (iii) the preparation method of the toner including the dispersion method. It is preferable that the amount the fluorine-containing quaternary ammonium salt be in the range of 0.1 to 20 parts by weight to 100 parts by weight of the binder resin from the viewpoints of the electric charge of the toner, the fluidity of a developer comprising the toner and carrier, and the image density obtained.

As previously mentioned, the fluorine-containing quaternary ammonium salt of formula (I) is preferably used in combination with a metal-containing azo dye as the charge controlling agent.

As the metal-containing azo dye, most of the commercially available products can be employed. For example, "Aizen Spilon Black TRH", "Aizen Color T-37" and "Aizen Color T-77" (Trademark), made by Hodogaya Chemical Co., Ltd.; and "Bontron S-32", "Bontron S-34", "Bontron S-40" and "Bontron S-44" (Trademark), made by Orient Chemical Industries, Ltd., are preferably used.

Specific examples of the binder resins for use in the present invention include homopolymers of styrene or its substitution compounds such as polystyrene, poly-p-chlorostyrene and polyvinyltoluene; styrene-based copolymers such as a styrene-p-chlorostyrene copolymer, a styrene-propylene copolymer, a styrene-vinyltoluene copolymer, a styrene-vinylnaphthalene copolymer, a styrene-methylacrylate copolymer, a styrene-ethylacrylate copolymer, a styrene-butylacrylate copolymer, a styrene-octylacrylate copolymer, a styrene-methylmethacrylate copolymer, a styrene-ethylmethacrylate copolymer, a styrene-butylmethacrylate copolymer, a styrene-methyl-α-chloro-methacrylate copolymer, a styrene-acrylonitrile copolymer, a styrene-vinylmethyl ether copolymer, a styrene-vinylethyl ether copolymer, a styrene-vinylmethyl ketone copolymer, a styrene-butadiene copolymer, a styrene-isoprene copolymer, a styrene-acrylonitrile-indene copolymer, a styrene-maleic acid copolymer and a styrene-maleic acid ester copolymer; polymethyl methacrylate, polybutyl methacrylate, polyvinyl chloride, polyvinyl acetate, polyethylene, polypropylene, polyester, polyurethane, polyamide, epoxy resin, polyvinyl butyral, a polyacrylic acid resin, rosin, modified rosin, terpene resin, phenolic resin, an aliphatic hydrocarbon resin, an alicyclic hydrocarbon resin, an aromatic petroleum resin, chlorinated paraffin, and a paraffin wax. The above resins can be used alone or in combination.

In particular, when a pressure-application image fixing method is employed, the following binder resins are preferably used alone or in combination: polyolefins such as low-molecular-weight polyethylene, low-molecular-weight polypropylene, polyethylene oxide, and polyethylene tetrafluoride; epoxy resin; polyester resin; styrene-butadiene copolymer (monomer ratio of 5–30:95–70); olefin copolymers such as ethylene-acrylic acid copolymer, ethylene-acrylic acid ester copolymer, ethylene-methacrylic acid copolymer, ethylene-methacrylic acid ester copolymer, ethylene-vinyl chloride copolymer, ethylene-vinyl acetate copolymer and ionomer resin; polyvinyl pyrrolidone; methyl vinyl ether-maleic anhydride copolymer; maleic-acid-modified phenolic resin; and phenol-modified terpene resin.

Of these binder resins, the polyester resin is preferable. The polyester resin is obtained by polycondensation of alcohol and carboxylic acid. Among the polyester resins, those which are prepared by polycondensation of a bisphenol-type diol and a polyvalent carboxylic acid, or alkylene glycol and a polyvalent carboxylic acid are, in particular, preferably employed as the binder resin.

Examples of the above alcohol to prepare the polyester resin are diols such as polyethylene glycol, diethylene glycol, triethylene glycol, 1,2-propylene glycol, 1,3-propylene glycol, 1,4-propylene glycol, neopentyl glycol and 1,4-butenediol; etherified bisphenols such as 1,4-bis(hydroxymethyl) cyclohexane, bisphenol A, hydrogeneted bisphenol A, polyoxyethylene bisphenol A and polyoxypropylene bisphenol A; bivalent alcohol units obtained by replacing the above diols or etherified bisphenols by a saturated or unsaturated hydrocarbon group having 3 to 22 carbon atoms; other bivalent alcohol units; and polyalcohol monomers with three or more valents such as sorbitol, 1,2,3,6-hexanetetrol, 1,4-sorbitan, pentaerythritol, tripentaerythritol, sucrose, 1,2,4-butanetriol, 1,2,5-pentanetriol, glycerol, 2-methylpropane triol, 2-methyl-1,2,4-butanetriol, trimethylolethane, trimethylolpropane and 1,3,5-trihydroxymethylbenzene.

Examples of the carboxylic acid to prepare the polyester resin are monocarboxylic acids such as palmitic acid, stearic acid and oleic acid; maleic acid, fumaric acid, mesaconic acid, citraconic acid, itaconic acid, phthalic acid, isophthalic acid, terephthalic acid, cyclohexanecarboxylic acid, succinic acid, adipic acid, sebacic acid, malonic acid, bivalent organic acid monomers obtained by replacing the above acids by a saturated or unsaturated hydrocarbon group having 3 to 22 carbon atoms; anhydrides of the above acids; dimers of lower alkyl esters and linolenic acid; other bivalent organic acid monomers; trimer acids such as benzene-1,2,4-tricarboxylic acid, benzene-1,2,5-tricarboxylic acid, cyclohexane-1,2,4-tricarboxylic acid, naphthalene-2,5,7-tricarboxylic acid, naphthalene-1,2,4-tricarboxylic acid, butane-1,2,4-tricarboxylic acid, hexane-1,2,5-tricarboxylic acid, 1,3-dicarboxyl-2-methyl-2-methylenecarboxy propane, tetra(methylenecarboxyl)methane and 1,2,7,8-octanetetracarboxylic acid; and polyvalent carboxylic acids such as anhydrides of the above trimer acids.

When the epoxy resin is used as the binder resin in the present invention, polycondensation products of bisphenol A and epichlorohydrin, for example, "Epomik R362", "Epomik R364", "Epomik R365", "Epomik R366", "Epomik R367" and "Epomik R369" (Trademark), commercially available from Mitsui Petrochemical Industries, Ltd.; "Epotohto YD-011", "Epotohto YD-012", "Epotohto YD-014", "Epotohto YD-904" and "Epotohto YD-017" (Trademark), made by Tohto Kasei Co., Ltd.; and "Epicote 1002", "Epicote 1004" and "Epicote 1007" (Trademark), made by Yuka Shell Epoxy K.K., are preferably used.

In the present invention, any of the conventional dyes and pigments can be used alone or in combination as the coloring agent.

Examples of the above conventional dyes and pigment are carbon black, Lamp Black, Iron Black, Ultramarine Blue, Nigrosine Dye, Aniline Blue, Phthalocyanine Blue, Phthalocyanine Green, Hansa Yellow G, Rhodamine 6G, Lake, Calconyl Blue, Chrome Yellow, quinacridone, Benzidine Yellow, Rose Bengale, triallyl methane dyes, monoazo pigments and dyes, and disazo pigments and dyes.

The toner of the present invention can be used as a magnetic toner by incorporating therein a magnetic material.

Examples of the magnetic material include iron oxides such as magnetite, hematite and ferrite; metals such as iron, cobalt and nickel; and alloys or mixtures of any of the above metals and a metal such as aluminum, cobalt, copper, lead, magnesium, tin, zinc, antimony, beryllium, bismuth, cadmium, calcium, manganese, selenium, titanium, tungsten or vanadium.

The average particle diameter of the above magnetic material is preferably 0.1 to 2 μm, and its incorporation amount is approximately 20 to 200 parts by weight, more preferably 40 to 150 parts by weight, per 100 parts by weight of the binder resin contained in the toner.

The toner according to the present invention can also be used as a two-component-type developer. In this case, the toner is mixed with a carrier powder. As such a carrier powder, any of the conventionally known carrier powder can be used. Examples of the carrier powder include powders having magnetic properties such as iron powder, ferrite powder and nickel powder, and glass beads. Furthermore, the above magnetic powders and glass beads can also be coated with a resin.

In the present invention, it is desirable that the carrier be prepared by coating carrier core particles with an electroconductive-finely-divided-particles-containing silicone resin. Due to the electroconductive-finely-divided-particles-containing silicone resin, the advantages of the conventional silicone-resin-coated carriers can be utilized, and at the same time, the electric charge is effectively prevented from accumulating in the carrier particles.

As the above-mentioned carrier core particles for use in the present invention, any of the conventionally known carrier particles may be employed. Examples of the carrier core particles are ferromagnetic metals such as iron, cobalt and nickel; alloys and metallic compounds such as magnetite, hematite and ferrite; and glass beads. It is preferable that the average diameter of the above carrier core particle be in the range of 10 to 1000 μm, and more preferably in the range of 30 to 500 μm. The amount of the silicone resin is generally in the range of 1 to 10 wt. % of the total weight of the carrier core particle.

Moreover, the toner of the present invention may further comprise any of the following auxiliary components, if necessary. As the auxiliary components, a releasant such as Teflon or zinc stearate, an abrasive substance such as cerium oxide or silicon carbide, a fluidity-imparting agent such as colloidal silica or aluminum oxide, a caking-preventing agent, an electroconductivity-imparting agent such as carbon black or tin oxide, and a fixing-accelerating agent such as polyolefin having a low molecular weight, can be employed in the present invention.

Other features of this invention will become apparent in the course of the following description of exemplary embodiments, which are given for illustration of the invention and are not intended to be limiting thereof.

(PREPARATION EXAMPLE 1-1—POLYESTER RESIN A)

The following components were mixed and stirred at 210° C. for about 6 hours.

| | Amount (mol) |
|---|---|
| Terephthalic acid | 7 |
| Succinic acid | 2 |
| Trimellitic acid | 1 |
| Polyoxyethylene(2)-2,2-bis(4-hydroxyphenyl)propane | 7 |
| Polyoxypropylene(2,2)-2,2-bis(4-hydroxyphenyl)propane | 3 |

After the completion of the reaction, the reaction mixture was cooled to room temperature, whereby a polyester resin A (Mw=153000, Mw/Mn=38 and Tg=65° C.) was obtained.

(PREPARATION EXAMPLE 1-2—Polyester Resin B)

The following components were mixed and stirred at 200° C. for about 7 hours.

| | Amount (mol) |
|---|---|
| Terephthalic acid | 6 |
| Adipic acid | 1 |
| Trimellitic acid | 1 |
| Oleic acid | 2 |
| Polyoxyethylene(2)-2,2-bis(4-hydroxyphenyl)propane | 6 |
| Polyoxypropylene(2,2)-2,2-bis(4-hydroxyphenyl)propane | 4 |

After the completion of the reaction, the reaction mixture was cooled to room temperature, whereby a polyester resin B (Mw=55000, Mw/Mn=20 and Tg=64° C.) was obtained.

(PREPARATION EXAMPLE 1-3—Polyester Resin C)

The following components were mixed and stirred at 220° C. for about 6 hours.

| | Amount (mol) |
|---|---|
| Isophthalic acid | 7 |
| n-dodecenyl succinic acid | 1 |
| Trimellitic acid | 1.5 |
| Oleic acid | 0.5 |
| Polyoxyethylene(2,5)-2,2-bis(4-hydroxyphenyl)propane | 10 |

After the completion of the reaction, the reaction mixture was cooled to room temperature, whereby a polyester resin C (Mw=132000, Mw/Mn=45 and Tg=68° C.) was obtained.

(PREPARATION EXAMPLE 1-4—Polyester Resin D)

The following components were mixed and stirred at 210° C. for about 7 hours.

| | Amount (mol) |
|---|---|
| Isophthalic acid | 8 |
| Maleic acid | 1 |
| Trimellitic acid | 0.5 |
| Stearic acid | 0.5 |
| Polyoxypropylene(2)-2,2-bis(4-hydroxyphenyl)propane | 10 |

After the completion of the reaction, the reaction mixture was cooled to room temperature, whereby a polyester resin D (Mw=185000, Mw/Mn=29 and Tg=63° C.) was obtained.

(PREPARATION EXAMPLE 1-5—Polyester Resin E)

The following components were mixed and stirred at 210° C. for about 6 hours.

| | Amount (mol) |
|---|---|
| Polyethylene glycol | 5 |
| Terephthalic acid | 8 |
| Succinic acid | 1 |
| Trimellitic acid | 1 |
| Polyoxyethylene(2)-2,2-bis(4-hydroxyphenyl)propane | 5 |

After the completion of the reaction, the reaction mixture was cooled to room temperature, whereby a polyester resin E (Mw=148000, Mw/Mn=36 and Tg=64° C.) was obtained.

(PREPARATION EXAMPLE 1-6—Polyester Resin F)

The following components were mixed and stirred at 200° C. for about 7 hours.

| | Amount (mol) |
|---|---|
| Terephthalic acid | 7 |
| Adipic acid | 1.5 |
| Oleic acid | 1.5 |
| Polyoxyethylene(2)-2,2-bis(4-hydroxyphenyl)propane | 3.5 |
| Polyoxypropylene(2,2)-2,2-bis(4-hydroxyphenyl)propane | 2.5 |
| Ethylene glycol | 4 |

After the completion of the reaction, the reaction mixture was cooled to room temperature, whereby a polyester resin F (Mw=57000, Mw/Mn=21 and Tg=66° C.) was obtained.

(PREPARATION EXAMPLE 1-7—Polyester Resin G)

The following components were mixed and stirred at 220° C. for about 6 hours.

| | Amount (mol) |
|---|---|
| Triethylene glycol | 6 |
| Isophthalic acid | 5 |
| n-dodecenyl succinic acid | 1 |
| Trimellitic acid | 2 |
| Oleic acid | 2 |
| Polyoxyethylene(2,5)-2,2-bis(4-hydroxyphenyl)propane | 4 |

After the completion of the reaction, the reaction mixture was cooled to room temperature, whereby a polyester resin G (Mw=150000, Mw/Mn=48 and Tg=71° C.) was obtained.

(PREPARATION EXAMPLE 1-8—Polyester Resin H)

The following components were mixed and stirred at 210° C. for about 7 hours.

| | Amount (mol) |
|---|---|
| 1,2-propylene glycol | 10 |
| Terephthalic acid | 2 |
| Maleic acid | 5 |
| Trimellitic acid | 1.5 |
| Stearic acid | 1.5 |

After the completion of the reaction, the reaction mixture was cooled to room temperature, whereby a polyester resin H (Mw=175000, Mw/Mn=28.9 and Tg=61° C.) was obtained.

(PREPARATION EXAMPLE 1-9—Polyester Resin J)

The following components were mixed and stirred at 210° C. for about 6 hours.

| | Amount (mol) |
|---|---|
| Polyethylene glycol | 8 |
| Terephthalic acid | 1 |
| Succinic acid | 3 |
| Trimellitic acid | 6 |
| Polyoxyethylene(2)-2,2-bis(4-hydroxyphenyl)propane | 2 |

After the completion of the reaction, the reaction mixture was cooled to room temperature, whereby a polyester resin J (Mw=152000, Mw/Mn=37 and Tg=62° C.) was obtained.

(PREPARATION EXAMPLE 1-10—Polyester Resin K)

The following components were mixed and stirred at 200° C. for about 7 hours.

| | Amount (mol) |
|---|---|
| Diethylene glycol | 5 |
| Terephthalic acid | 1 |
| Adipic acid | 3 |
| Oleic acid | 7 |
| Polyoxyethylene(2)-2,2-bis(4-hydroxyphenyl)propane | 5 |

After the completion of the reaction, the reaction mixture was cooled to room temperature, whereby a polyester resin K (Mw=90000, Mw/Mn=20 and Tg=61° C.) was obtained.

(PREPARATION EXAMPLE 1-11—Polyester Resin L)

The following components were mixed and stirred at 220° C. for about 6 hours.

| | Amount (mol) |
|---|---|
| Triethylene glycol | 4 |
| Isophthalic acid | 4 |
| n-dodecenyl succinic acid | 3 |
| Trimellitic acid | 1 |
| Oleic acid | 2 |
| Polyoxyethylene(2,5)-2,2-bis(4-hydroxyphenyl)propane | 6 |

After the completion of the reaction, the reaction mixture was cooled to room temperature, whereby a polyester resin L (Mw=148000, Mw/Mn=46 and Tg=70° C.) was obtained.

(PREPARATION EXAMPLE 1-12—Polyester Resin M)

The following components were mixed and stirred at 210° C. for about 7 hours.

| | Amount (mol) |
|---|---|
| 1,2-propylene glycol | 10 |
| Terephthalic acid | 3 |
| Maleic acid | 3 |
| Trimellitic acid | 2.5 |
| Stearic acid | 1.5 |

After the completion of the reaction, the reaction mixture was cooled to room temperature, whereby a polyester resin M (Mw=161000, Mw/Mn=27.2 and Tg=58° C.) was obtained.

(PREPARATION EXAMPLE 2-1—CARRIER A)

The following components were dispersed in a homomixer for 30 minutes, so that a coating solution for the carrier core particles was prepared.

| | Parts by Weight |
|---|---|
| Silicone resin solution ["KR250" (Trademark), made by Shin-Etsu Polymer Co., Ltd.] | 100 |
| Carbon black ["#44" (Trademark), made by Mitsubishi Carbon Co.] | 2 |
| Toluene | 100 |

The above-prepared coating solution was coated on the surfaces of 1000 parts by weight of ferrite particles with an average particle diameter of 100 μm by using a fluidized bed coating apparatus, so that a carrier A was prepared.

(PREPARATION EXAMPLE 2-2 TO 2-8—CARRIERS B TO H)

The following coating material and electroconductive finely-divided particles as shown in Table 1 were dispersed in a homomixer for 30 minutes with the addition thereto of 100 parts by weight of toluene, so that the respective coating solutions for the carrier core particles were obtained.

Each of the above-prepared coating solution was coated on the surfaces of 1000 parts by weight of ferrite particles with an average particle diameter of 100 μm by using a fluidized bed coating apparatus, so that carriers B to H were prepared.

TABLE 1

| | Coating Material | | Electroconductive Finely-divided Particles | |
|---|---|---|---|---|
| | Kind | A-mount* | Kind | Amount* |
| Ex. 2-2 Carrier B | Silicone resin "KR206" made by Shin-Etsu Polymer Co., Ltd. | 100 | Carbon black "#44" made by Mitsubishi Carbon Co. | 1.4 |
| Ex. 2-3 Carrier C | Silicone resin "KR206" made by Shin-Etsu Polymer Co., Ltd. | 100 | Carbon black "BPL" made by Cabot Corporation | 5 |
| Ex. 2-4 Carrier D | Silicone resin "KR206" made by Shin-Etsu Polymer Co., Ltd. | 100 | Carbon black "Mogul L" made by Cabot Corporation | 3 |
| Ex. 2-5 | Silicone resin | 100 | Carbon black | 3 |

TABLE 1-continued

| | Coating Material | | Electroconductive Finely-divided Particles | |
|---|---|---|---|---|
| | Kind | A-mount* | Kind | Amount* |
| Carrier E | "KR206" made by Shin-Etsu Polymer Co., Ltd. | | "#44" made by Mitsubishi Carbon Co. | |
| Ex. 2-6 | Silicone resin | 100 | Carbon black | 2.5 |
| Carrier F | "KR206" made by Shin-Etsu Polymer Co., Ltd. | | "#44" made by Mitsubishi Carbon Co. | |
| Ex. 2-7 | Silicone resin | 100 | Carbon black | 7 |
| Carrier G | "KR206" made by Shin-Etsu Polymer Co., Ltd. | | "BPL" made by Cabot Corporation | |
| Ex. 2-8 | Silicone resin | 100 | Carbon black | 4 |
| Carrier H | "KR206" made by Shin-Etsu Polymer Co., Ltd. | | "Mogel L" made by Cabot Corporation | |

*The unit is "parts by weight".

EXAMPLE 1

The following components were mixed in a Henschel mixer and kneaded for about 30 minutes in a roll mill which was maintained at 130° to 140° C.

| | Parts by Weight |
|---|---|
| Styrene-2-ethylhexyl acrylate copolymer | 100 |
| C.I.Pigment Blue 15 | 5 |
| Fluorine-containing quaternary ammonium salt (1) | 1.5 |

The thus obtained mixture was cooled to room temperature, pulverized and classifed, so that a blue toner with a particle diameter of 5 to 20 μm was obtained.

2.5 parts by weight of the above prepared toner and 97.5 parts by weight of silicone-resin-coated ferrite carrier particles having a particle size of 100 to 250 meshes were mixed in a ball mill, whereby a two-component type developer No. 1 according to the present invention was obtained.

The thus obtained developer No. 1 according to the present invention was subjected to an image formation test using a commercially available electrophotographic copying machine "FT-4060" (Trademark), made by Ricoh Company, Ltd. The initial images obtained by the above test were clear blue. Even after 200,000 copies were made, the obtained images were still excellent in quality.

The initial charge quantity of the toner, measured by the blow-off method, was −17.5 μC/g. After the making of 200,000 copies, the charge quantity of the toner was −15.8 μC/g, which was almost the same as the initial charge quantity of the toner.

In addition, under the conditions of high humidity of 90% RH at 35° C., and low humidity of 15% RH at 10° C., the image quality of the obtained images did not deteriorate.

The film forming of the toner on the photoconductor was not observed.

EXAMPLE 2

The following components were mixed in a Henschel mixer and kneaded for about 30 minutes in a roll mill which was maintained at 130° to 140° C.

| | Parts by Weight |
|---|---|
| Polyester resin "Lunapale 1438-6" (Trademark) made by Arakawa Chemical Industries, Ltd. | 100 |
| Polypropylene | 5 |
| Carbon black | 10 |
| Fluorine-containing quaternary ammonium salt (1) | 2 |

The thus obtained mixture was cooled to room temperature, pulverized and classifed, so that a black toner with a particle diameter of 5 to 25 μm was obtained.

2.5 parts by weight of the above prepared toner and 97.5 parts by weight of silicone-resin-coated ferrite carrier particles having a particle size of 100 to 250 meshes were mixed in a ball mill, whereby a two-component type developer No. 2 according to the present invention was obtained.

The thus obtained developer No. 2 according to the present invention was subjected to the same image formation test as in Example 1. The initial images obtained by the above test were sharp. Even after 200,000 copies were made, the obtained images were still excellent in quality.

The initial charge quantity of the toner, measured by the blow-off method, was −20.5 μC/g. After the making of 200,000 copies, the charge quantity of the toner was −19.2 μC/g, which was almost the same as the initial charge quantity of the toner.

In addition, under the conditions of high humidity of 90% RH at 35° C., and low humidity of 15% RH at 10° C., the image quality of the obtained images did not deteriorate.

The film forming of the toner on the photoconductor was not observed.

COMPARATIVE EXAMPLE 1

The procedure for preparation of the two-component type developer No. 1 in Example 1 was repeated except that the fluorine-containing quaternary ammonium salt (1) was replaced by a commercially available zinc salt of salicylic acid "E-84" (Trademark), made by Orient Chemical Industried, Ltd., so that a comparative two-component type developer No. 1 was obtained.

The thus obtained comparative developer No. 1 was subjected to the same image formation test as in Example 1. The initial images obtained by the above test were sharp. After 100,000 copies were made, the obtained images became unclear with fogging. The film forming of the toner on the photoconductor was observed.

The initial charge quantity of the toner, measured by the blow-off method, was −12.5 μC/g. After the making of 100,000 copies, the charge quantity of the toner decreased to −5.5 μC/g.

In addition, under the conditions of high humidity of 90% RH at 35° C., the image density of the obtained images was as low as 0.95, and the obtained images were unclear with fogging.

EXAMPLE 3

The following components were mixed in a Henschel mixer and kneaded for about 30 minutes in a roll mill which was maintained at 130° to 140° C.

| | Parts by Weight |
|---|---|
| Epoxy resin "R365" (Trademark) made by Mitsui Petrochemical Industries, Ltd. | 80 |
| Epoxy resin "YD-017" (Trademark) made by Toto Kasei Co., Ltd. | 20 |
| C.I.Pigment Blue 15 | 5 |
| C.I.Pigment Yellow 17 | 5 |
| Fluorine-containing quaternary ammonium salt (2) | 2 |

The thus obtained mixture was cooled to room temperature, pulverized and classifed, so that a green toner with a particle diameter of 5 to 20 μm was obtained.

100 parts by weight of the above prepared toner, 3 parts by weight of silicon carbide with a particle diameter of 2 μm and 0.1 part by weigh of hydrophobic colloidal silica were thoroughly mixed in a speed kneader, whereby a one-component type developer No. 3 according to the present invention was obtained.

The thus obtained developer No. 3 according to the present invention was subjected to an image formation test using an electrophotographic copying machine as shown in FIGURE. The initial images obtained by the above test were clear green. Even after 50,000 copies were made, the obtained images were still excellent in quality.

The developer No. 3 according to the present invention can be used as a one-component type developer in a development unit as shown in the single figure. In the development unit in the single figure, an electric charge of −800 volts d.c. was uniformly applied to a latent electrostatic image bearing member 1, and the latent electrostatic image bearing member 1 was exposed to light images to form a latent electrostatic image thereon. A toner 6 accumulated in a toner reservoir 7 is forcibly brought onto a sponge roller 4 by a stirring blade 5, so that the toner 6 is supplied onto the sponge roller 4. As the sponge roller 4 is rotated in the direction of the arrow, the toner 6 fed to the sponge roller 4 is transported onto a toner transportation member 2, where the toner 6 is frictioned, and electrostatically or physically attracted to the toner transportation member 2. As the toner transportation member 2 is rotated in the direction of the arrow, a uniformly thin layer of the toner 6 is formed on the toner transportation member 2 by an elastic blade 3. At the same time, the thin layer of the toner 6 is triboelectrically charged. The toner 6 is then transported onto the surface of the latent electrostatic image bearing member 1 which is situated in contact with or adjacent to the toner transportation member 2, so that the latent electrostatic image is developed to a visible toner image.

The initial charge quantity (Q/M) of the toner on the toner transportation member 2 as shown in the single figure, measured by use of a specific charge quantity measuring apparatus, was −11.2 μC/g. In the above specific charge quantity measuring apparatus, the toner particles on the toner transportation member 2 were sucked by a Faraday cage, with a filter layer equipped at an outlet thereof, and trapped therein to measure the charge quantity of the toner. After the making of 50,000 copies, the charge quantity of the toner was −10.1 μC/g, which was almost the same as the initial charge quantity of the toner.

In addition, under the conditions of high humidity and low humidity, the image quality of the obtained images did not deteriorate.

The film forming of the toner on the photoconductor was not observed.

EXAMPLE 4

The following components were mixed in a Henschel mixer and kneaded for about 30 minutes in a roll mill which was maintained at 130° to 140° C.

| | Parts by Weight |
|---|---|
| Polyester resin "Lunapale 1447" (Trademark) made by Arakawa Chemical Industries, Ltd. | 100 |
| Polypropylene | 5 |
| Carbon black | 10 |
| Fluorine-containing quaternary ammonium salt (1) | 0.5 |
| Metal-containing monoazo dye "S-34" (Trademark) made by Orient Chemical Industries, Ltd. | 1.5 |

The thus obtained mixture was cooled to room temperature, pulverized and classifed, so that a black toner with a particle diameter of 5 to 25 μm was obtained.

2.5 parts by weight of the above prepared toner and 97.5 parts by weight of silicone-resin-coated ferrite carrier particles having a particle size of 100 to 250 meshes were mixed in a ball mill, whereby a two-component type developer No. 4 according to the present invention was obtained.

The thus obtained developer No. 4 according to the present invention was subjected to the same image formation test as in Example 1. The initial images obtained by the above test were sharp. Even after 200,000 copies were made, the obtained images were still excellent in quality.

The initial charge quantity of the toner, measured by the blow-off method, was −22.1 μC/g. After the making of 200,000 copies, the charge quantity of the toner was −20.8 μC/g, which was almost the same as the initial charge quantity of the toner.

In addition, under the conditions of high humidity of 90% RH at 35° C., and low humidity of 15% RH at 10° C., the image quality of the obtained images did not deteriorate.

The film forming of the toner on the photoconductor was not observed.

COMPARATIVE EXAMPLE 2

The procedure for preparation of the two-component type developer No. 4 in Example 4 was repeated except that the fluorine-containing quaternary ammonium salt (1) was not used, so that a comparative two-component type developer No. 2 was obtained.

The thus obtained comparative developer No. 2 was subjected to the same image formation test as in Example 1. The initial images obtained by the above test were poor in quality with slight fogging. After 5,000 copies were made, the obtained images became unclear with fogging.

The initial charge quantity of the toner, measured by the blow-off method, was −10.5 μC/g. After the making of 5,000 copies, the charge quantity of the toner decreased to −1.5 μC/g.

In addition, under the conditions of high humidity of 90% RH at 35° C., the image density of the obtained images was as low as 0.86, and the obtained images were unclear with fogging.

EXAMPLE 5

The following components were mixed in a Henschel mixer and kneaded for about 40 minutes in a roll mill which was maintained at 110° to 120° C.

| | Parts by Weight |
|---|---|
| Polyester resin "Lunapale 1447" (Trademark) made by Arakawa Chemical Industries, Ltd. | 100 |
| Candelilla wax "102" (Trademark) made by Noda Wax Co., Ltd. | 5 |
| C.I.Pigment Red 57 | 5 |
| C.I.Pigment Red 48 | 3 |
| Fluorine-containing quaternary ammonium salt (6) | 2 |

The thus obtained mixture was cooled to room temperature, pulverized and classifed, so that a red toner with a particle diameter of 5 to 20 μm was obtained.

100 parts by weight of the above prepared toner, 3 parts by weight of silicon carbide with a particle diameter 2 μm and 0.1 part by weigh of hydrophobic colloidal silica were thoroughly mixed in a speed kneader, whereby a one-component type developer No. 5 according to the present invention was obtained.

The thus obtained developer No. 5 according to the present invention was subjected to the same image formation test as in Example 3. The initial images obtained by the above test were clear red. Even after 50,000 copies were made, the obtained images were still excellent in quality.

The initial charge quantity of the toner, measured by the same manner as in Example 3, was −21.5 μC/g. After the making of 50,000 copies, the charge quantity of the toner was −20.4 μC/g, which was almost the same as the initial charge quantity of the toner.

In addition, under the conditions of high humidity and low humidity, the image quality of the obtained images did not deteriorate.

The film forming of the toner on the photoconductor was not observed.

EXAMPLES 6 TO 9

The procedure for preparation of the two-component type developer No. 1 according to the present invention in Example 1 was repeated except that the developer composition employed in Example 1 was replaced by the respective developer compositions as shown in Table 2, so that two-component type developers No. 6 to No. 9 according to the present invention were obtained.

Each of the above-prepared developers No. 6 to No. 9 according to the present invention was subjected to the same image formation test as in Example 1. The image quality and the charge quantity of the toner are given in Table 2.

TABLE 2

| Example No. | Formation of Developer | Parts by Weight | Image Quality: Initial Stage | Image Quality: 200,000th Copy | Charge Quantity of Tone (μC/g): Initial Stage | Charge Quantity of Tone (μC/g): 200,000th Copy |
|---|---|---|---|---|---|---|
| 6 | Toner Composition | | Clear blue | Almost the same as that in the initial stage | −23.1 | −21.6 |
| | Fluorine-containing quaternary ammonium salt (3) | 2.5 | | | | |
| | Polyethylene wax | 60 | | | | |
| | Ethylene-vinyl acetate copolymer | 40 | | | | |
| | C.I. Pigment Blue 15 | 4 | | | | |
| | Carrier Composition | | | | | |
| | Silicone-resin-coated ferrite | | | | | |
| 7 | Toner Composition | | Clear black | Almost the same as that in the initial stage | −19.5 | −18.6 |
| | Fluorine-containing quaternary ammonium salt (4) | 2 | | | | |
| | Polyester resin "RN-7" made by Kao Soap Co., Ltd. | 95 | | | | |
| | Polypropylene | 5 | | | | |
| | Carbon black | 10 | | | | |
| | Carrier Composition | | | | | |
| | Iron oxide powder | | | | | |
| 8 | Toner Composition | | Clear yellow | Almost the same as that in the initial stage | −17.1 | −16.5 |
| | Fluorine-containing quaternary ammonium salt (11) | 0.5 | | | | |
| | Zinc salt of salicylic acid "E-84" | 1 | | | | |
| | Mixture of epoxy resins used in Example 3 | 100 | | | | |
| | Polyethylene | 5 | | | | |
| | C.I. Disperse Yellow 33 | 5 | | | | |
| | Carrier Composition | | | | | |
| | Silicone-resin-coated ferrite | | | | | |
| 9 | Toner Composition | | Clear green | Almost the same as that in the initial stage | −20.6 | −19.3 |
| | Fluorine-containing quaternary ammonium salt (14) | 3.5 | | | | |
| | Polyester resin "R2380" | 100 | | | | |

TABLE 2-continued

| Example No. | Formation of Developer | Parts by Weight | Image Quality Initial Stage | Image Quality 200,000th Copy | Charge Quantity of Tone (μC/g) Initial Stage | Charge Quantity of Tone (μC/g) 200,000th Copy |
|---|---|---|---|---|---|---|
| | made by Kao Soap Co., Ltd. | | | | | |
| | Polypropylene | 5 | | | | |
| | C.I. Pigment Blue 15 | 5 | | | | |
| | C.I. Pigment Yellow 17 | 3 | | | | |
| | Carrier Composition | | | | | |
| | Iron oxide powder | | | | | |

EXAMPLE 10

The following components were mixed in a Henschel mixer and kneaded for about 30 minutes in a roll mill which was maintained at 130° to 140° C.

| | Parts by Weight |
|---|---|
| Polyester A (prepared in Preparation Example 1-1) | 100 |
| C.I. Pigment Blue | 5 |
| C.I. Pigment Red 48 | 3 |
| Fluorine-containing quaternary ammonium salt (1) | 2.5 |

The thus obtained mixture was cooled to room temperature, pulverized and classifed, so that a blue toner with a particle diameter of 5 to 20 μm was obtained.

2.5 parts by weight of the above prepared toner and 97.5 parts by weight of the carrier A which was prepared in Preparation Example 2-1 in a ball mill, whereby a two-component type developer No. 10 according to the present invention was obtained.

The thus obtained developer No. 10 according to the present invention was subjected to an image formation test using a commercially available electrophotographic copying machine "FT-7570" (Trademark), made by Ricoh Company, Ltd. The initial images obtained by the above test were clear blue. Even after 100,000 copies were made, the obtained images were still excellent in quality.

The initial charge quantity of the toner, measured by the blow-off method, was −20.5 μC/g. After the making of 100,000 copies, the charge quantity of the toner was −19.6 μC/g, which was almost the same as the initial charge quantity of the toner.

In addition, under the high humidity of 90% RH at 35° C., the charge quantity of the toner was −18.7 μC/g, and under the low humidity of 15% RH at 10° C., the charge quantity of the toner was −22.3 μC/g.

A sample of the toner images obtained in the above image formation test was interposed between two polyvinyl chloride mats made by Plus Co., Ltd., and allowed to stand at 50° C. for 24 hours. After 24 hours, the toner images did not adhere to the polyvinyl chloride mats.

The charge quantities of the toner at the initial stage and after the making of 100,000 copies at room temperature and humidity, and the charge quantities at 90% RH and 35° C., and 15% RH and 10° C., obtained from the image formation tests in Example 10 are shown in Table 3.

The results of the image formation tests with respect to the following Examples 11 through 45 are also shown in Table 3.

COMPARATIVE EXAMPLE 3

The procedure for preparation of the two-component type developer No. 10 in Example 10 was repeated except that the fluorine-containing quaternary ammonium salt (1) was replaced by a commercially available chromium-containing monoazo dye "S-34" (Trademark), made by Hodogaya Chemical Co., Ltd., so that a comparative two-component type developer No. 3 was obtained.

The thus obtained comparative developer No. 3 was subjected to the same image formation test as in Example 10. The initial images obtained by the above test were sharp. After 10,000 copies were made, the obtained images became unclear with fogging.

The initial charge quantity of the toner, measured by the blow-off method, was −12.6 μC/g. After the making of 10,000 copies, the charge quantity of the toner decreased to −2.7 μC/g.

In addition, under the conditions of high humidity of 90% RH at 35° C., the charge quantity of the toner was −1.2 μC/g and the image density of the obtained images was as low as 0.43, and the obtained images were unclear with fogging.

EXAMPLE 11

The following components were mixed in a Henschel mixer and kneaded for about 30 minutes in a roll mill which was maintained at 130° to 140° C.

| | Parts by Weight |
|---|---|
| Polyester B (prepared in Preparation Example 1-2) | 100 |
| C.I. Pigment Red 57 | 5 |
| C.I. Pigment Red 48 | 3 |
| Fluorine-containing quaternary ammonium salt (15) | 2.5 |

The thus obtained mixture was cooled to room temperature, pulverized and classifed, so that a red toner with a particle diameter of 5 to 20 μm was obtained.

2.5 parts by weight of the above prepared toner and 97.5 parts by weight of the carrier A which was prepared in Preparation Example 2-1 in a ball mill, whereby a two-component type developer No. 11 according to the present invention was obtained.

The thus obtained developer No. 11 according to the present invention was subjected to the same image formation test as in Example 10. The initial images obtained by the above test were clear red. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

EXAMPLE 12

The following components were mixed in a Henschel mixer and kneaded for about 30 minutes in a roll mill which was maintained at 130° to 140° C.

| | Parts by Weight |
|---|---|
| Polyester A (prepared in Preparation Example 1-1) | 100 |
| Low-molecular-weight polypropylene | 5 |
| C.I. Pigment Blue 15 | 5 |
| C.I. Pigment Yellow 17 | 5 |
| Fluorine-containing quaternary ammonium salt (16) | 1.5 |

The thus obtained mixture was cooled to room temperature, pulverized and classifed, so that a green toner with a particle diameter of 5 to 20 μm was obtained.

3.5 parts by weight of the above prepared toner and 96.5 parts by weight of the carrier C which was prepared in Preparation Example 2-3 in a ball mill, whereby a two-component type developer No. 12 according to the present invention was obtained.

The thus obtained developer No. 12 according to the present invention was subjected to the same image formation test as in Example 10. The initial images obtained by the above test were clear green. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

COMPARATIVE EXAMPLE 4

The procedure for preparation of the two-component type developer No. 11 in Example 11 was repeated except that the fluorine-containing quaternary ammonium salt (15) was replaced by a commercially available zinc salt of salicylic acid "E-84" (Trademark), made by Orient Chemical Industries, Ltd., so that a comparative two-component type developer No. 4 was obtained.

The thus obtained comparative developer No. 4 was subjected to the same image formation test as in Example 10. The initial images obtained by the above test were sharp. At ordinary humidity, the obtained images were clear without fogging. Under the conditions of high humidity of 90% RH at 35° C., the image density of the obtained images was as low as 0.75, and the obtained images were unclear with fogging.

The charge quantity of the toner at ordinary humidity, measured by the blow-off method, was −15.2 μC/g. Under the conditions of high humidity of 90% RH at 35° C., the charge quantity of the toner decreased to −6.1 μC/g.

EXAMPLE 13

The following components were mixed in a Henschel mixer and kneaded for about 30 minutes in a roll mill which was maintained at 130° to 140° C.

| | Parts by Weight |
|---|---|
| Polyester C (prepared in Preparation Example 1-3) | 95 |
| Carnauba wax free from free fatty acid "NA-X-02" (Trademark) made by Noda Wax Co., Ltd. | 5 |
| Carbon black "#44" (Trademark) made by Mitsubishi Carbon Co. | 10 |
| Fluorine-containing quaternary ammonium salt (19) | 2 |

The thus obtained mixture was cooled to room temperature, pulverized and classifed, so that a black toner with a particle diameter of 5 to 25 μm was obtained.

3.0 parts by weight of the above prepared toner and 97.0 parts by weight of the carrier D which was prepared in Preparation Example 2-4 in a ball mill, whereby a two-component type developer No. 13 according to the present invention was obtained.

The thus obtained developer No. 13 according to the present invention was subjected to the same image formation test as in Example 10. The initial images obtained by the above test were clear. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

EXAMPLE 14

The following components were mixed in a Henschel mixer and kneaded for about 30 minutes in a roll mill which was maintained at 130° to 140° C.

| | Parts by Weight |
|---|---|
| Polyester D (prepared in Preparation Example 1-4) | 100 |
| Carbon black "#44" (Trademark) made by Mitsubishi Carbon Co. | 10 |
| Fluorine-containing quaternary ammonium salt (21) | 2 |

The thus obtained mixture was cooled to room temperature, pulverized and classifed, so that a black toner with a particle diameter of 5 to 25 μm was obtained.

2.5 parts by weight of the above prepared toner and 97.5 parts by weight of the carrier A which was prepared in Preparation Example 2-1 in a ball mill, whereby a two-component type developer No. 14 according to the present invention was obtained.

The thus obtained developer No. 14 according to the present invention was subjected to the same image formation test as in Example 10. The initial images obtained by the above test were clear. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

EXAMPLE 15

The following components were mixed in a Henschel mixer and kneaded for about 30 minutes in a roll mill which was maintained a 130° to 140° C.

| | Parts by Weight |
|---|---|
| Polyester D (prepared in Preparation Example 1-4) | 95 |
| Low-molecular-weight polypropylene | 5 |
| C.I. Pigment Blue 15 | 5 |
| Fluorine-containing quaternary ammonium salt (23) | 2 |

The thus obtained mixture was cooled to room temperature, pulverized and classifed, so that a blue toner with a particle diameter of 5 to 20 μm was obtained.

2.5 parts by weight of the above prepared toner and 97.5 parts by weight of the carrier B which was prepared in Preparation Example 2-2 in a ball mill, whereby a two-component type developer No. 15 according to the present invention was obtained.

The thus obtained developer No. 15 according to the present invention was subjected to the same image formation test as in Example 10. The initial images obtained by the above test were clear blue. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

EXAMPLE 16

The following components were mixed in a Henschel mixer and kneaded for about 30 minutes in a roll mill which was maintained at 130° to 140° C.

| | Parts by Weight |
|---|---|
| Polyester E (prepared in Preparation Example 1-5) | 100 |
| C.I. Pigment Blue 15 | 4 |
| Fluorine-containing quaternary ammonium salt (1) | 3 |

The thus obtained mixture was cooled to room temperature, pulverized and classifed, so that a blue toner with a particle diameter of 5 to 20 μm was obtained.

2.5 parts by weight of the above prepared toner and 97.5 parts by weight of the carrier A which was prepared in Preparation Example 2-1 in a ball mill, whereby a two-component type developer No. 16 according to the present invention was obtained.

The thus obtained developer No. 16 according to the present invention was subjected to the same image formation test as in Example 10. The initial images obtained by the above test were clear blue. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

COMPARATIVE EXAMPLE 5

The procedure for preparation of the two-component type developer No. 16 in Example 16 was repeated except that the fluorine-containing quaternary ammonium salt (1) was replaced by a commercially available chromium-containing monoazo dye "S-34" (Trademark), made by Hodogaya Chemical Co., Ltd., so that a comparative two-component type developer No. 5 was obtained.

The thus obtained comparative developer No. 5 was subjected to the same image formation test as in Example 10. The initial images obtained by the above test were sharp. After 10,000 copies were made, the obtained images became unclear with fogging.

The initial charge quantity of the toner, measured by the blow-off method, was −17.2 μC/g. After the making of 10,000 copies, the charge quantity of the toner decreased to −2.7 μC/g.

In addition, under the conditions of high humidity of 90% RH at 35° C., the charge quantity of the toner was −1.5 μC/g and the image density of the obtained images was as low as 0.43, and the obtained images were unclear with fogging.

EXAMPLE 17

The following components were mixed in a Henschel mixer and kneaded for about 30 minutes in a roll mill which was maintained at 130° to 140° C.

| | Parts by Weight |
|---|---|
| Polyester F (prepared in Preparation Example 1-6) | 100 |
| C.I. Pigment Red 57 | 5 |
| C.I. Pigment Red 48 | 3 |
| Fluorine-containing quaternary ammonium salt (15) | 2.5 |

The thus obtained mixture was cooled to room temperature, pulverized and classifed, so that a red toner with a particle diameter of 5 to 20 μm was obtained.

100 parts by weight of the above prepared toner and 0.3 parts by weight of the hydrophobic colloidal silica were thoroughly mixed in a speed kneader ball mill, whereby a one-component type developer No. 17 according to the present invention was obtained.

The thus obtained developer No. 17 according to the present invention was subjected to the same image formation test as in Example 10. The initial images obtained by the above test were clear red. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

EXAMPLE 18

The following components were mixed in a Henschel mixer and kneaded for about 30 minutes in a roll mill which was maintained at 130° to 140° C.

| | Parts by Weight |
|---|---|
| Polyester E (prepared in Preparation Example 1-5) | 100 |

-continued

| | Parts by Weight |
|---|---|
| Low-molecular-weight polypropylene | 5 |
| C.I. Pigment Blue 15 | 5 |
| C.I. Pigment Yellow 17 | 5 |
| Fluorine-containing quaternary ammonium salt (16) | 1.5 |

The thus obtained mixture was cooled to room temperature, pulverized and classifed, so that a green toner with a particle diameter of 5 to 20 μm was obtained.

Four parts by weight of the above prepared toner and 96 parts by weight of the carrier C which was prepared in Preparation Example 2-3 in a ball mill, whereby a two-component type developer No. 18 according to the present invention was obtained.

The thus obtained developer No. 18 according to the present invention was subjected to the same image formation test as in Example 10. The initial images obtained by the above test were clear green. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

COMPARATIVE EXAMPLE 6

The procedure for preparation of the one-component type developer No. 17 in Example 17 was repeated except that the fluorine-containing quaternary ammonium salt (15) was replaced by a commercially available zinc salt of salicylic acid "E-84" (Trademark), made by Orient Chemical Industries, Ltd., so that a comparative one-component type developer No. 6 was obtained.

The thus obtained comparative developer No. 6 was subjected to the same image formation test as in Example 10. The images obtained by the above test at ordinary humidity were sharp. At ordinary humidity, the obtained images were clear without fogging. Under the conditions of high humidity of 90% RH at 35° C., the image density of the obtained images was as low as 0.6, and the obtained images were unclear with fogging.

The charge quantity of the toner at ordinary humidity, measured by the blow-off method, was −4.2 μC/g. Under the conditions of high humidity of 90% RH at 35° C., the charge quantity of the toner decreased to −6.1 μC/g.

EXAMPLE 19

The following components were mixed in a Henschel mixer and kneaded for about 30 minutes in a roll mill which was maintained at 130° to 140° C.

| | Parts by Weight |
|---|---|
| Polyester G (prepared in Preparation Example 1-7) | 95 |
| Carnauba wax free from free fatty acid "NA-X-02" (Trademark) made by Noda Wax Co., Ltd. | 5 |
| Carbon black "#44" (Trademark) made by Mitsubishi Carbon Co. | 10 |
| Fluorine-containing quaternary ammonium salt (19) | 2 |

The thus obtained mixture was cooled to room temperature, pulverized and classifed, so that a black toner with a particle diameter of 5 to 25 μm was obtained.

3.0 parts by weight of the above prepared toner and 97.0 parts by weight of the carrier D which was prepared in Preparation Example 2-4 in a ball mill, whereby a two-component type developer No. 19 according to the present invention was obtained.

The thus obtained developer No. 19 according to the present invention was subjected to the same image formation test as in Example 10. The initial images obtained by the above test were clear. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

EXAMPLE 20

The following components were mixed in a Henschel mixer and kneaded for about 30 minutes in a roll mill which was maintained at 130° to 140° C.

| | Parts by Weight |
|---|---|
| Polyester H (prepared in Preparation Example 1-8) | 100 |
| Carbon black "#44" (Trademark) made by Mitsubishi Carbon Co. | 10 |
| Fluorine-containing quaternary ammonium salt (21) | 2 |

The thus obtained mixture was cooled to room temperature, pulverized and classifed, so that a black toner with a particle diameter of 5 to 25 μm was obtained.

2.5 parts by weight of the above prepared toner and 97.5 parts by weight of the carrier A which was prepared in Preparation Example 2-1 in a ball mill, whereby a two-component type developer No. 20 according to the present invention was obtained.

The thus obtained developer No. 20 according to the present invention was subjected to the same image formation test as in Example 10. The initial images obtained by the above test were clear. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

EXAMPLE 21

The following components were mixed in a Henschel mixer and kneaded for about 30 minutes in a roll mill which was maintained at 130° to 140° C.

| | Parts by Weight |
|---|---|
| Polyester H (prepared in | 95 |

-continued

| | Parts by Weight |
|---|---|
| Preparation Example 1-8) | |
| Low-molecular-weight polypropylene | 5 |
| C.I. Pigment Blue 15 | 5 |
| Fluorine-containing quaternary ammonim salt (23) | 2 |

The thus obtained mixture was cooled to room temperature, pulverized and classifed, so that a blue toner a particle diameter of 5 to 20 μm was obtained.

2.5 parts by weight of the above prepared toner and 97.5 parts by weight of the carrier B which was prepared in Preparation Example 2-2 in a ball mill, whereby a two-component type developer No. 21 according to the present invention was obtained.

The thus obtained developer No. 21 according to the present invention was subjected to the same image formation test as in Example 10. The initial images obtained by the above test were clear blue. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

EXAMPLE 22

The following components were mixed in a Henschel mixer and kneaded for about 30 minutes in a roll mill which was maintained at 130° to 140° C.

| | Parts by Weight |
|---|---|
| Polyester A (prepared in Preparation Example 1-1) | 100 |
| Carbon black "#44" (Trademark) made by Mitsubishi Carbon Co. | 10 |
| Fluorine-containing quaternary ammonium salt (1) | 1 |
| Metal-containing azo dye "Bontron S-34" (Trademark) made by Orient Chemical Industries, Ltd. | 2 |

The thus obtained mixture was cooled to room temperature, pulverized and classifed, so that a black toner with a particle diameter of 5 to 20 μm was obtained.

2.5 parts by weight of the above prepared toner and 97.5 parts by weight of the carrier A which was prepared in Preparation Example 2-1 in a ball mill, whereby a two-component type developer No. 22 according to the present invention was obtained.

The thus obtained developer No. 22 according to the present invention was subjected to the same image formation test as in Example 10. The initial images obtained by the above test were clear. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

COMPARATIVE EXAMPLE 7

The procedure for preparation of the two-component type developer No. 22 in Example 22 was repeated except that the fluorine-containing quaternary ammonium salt (1) was not used, so that a comparative two-component type developer No. 7 was obtained.

The type obtained comparative developer No. 7 was subjected to the same image formation test as in Example 10. The initial images obtained by the above test were clear without fogging. After 10,000 copies were made, the obtained images became unclear with fogging.

The initial charge quantity of the toner, measured by the blow-off method, was −12.6 μC/g. After the making of 10,000 copies, the charge quantity of the toner decreased to −2.7 μC/g.

In addition, under the conditions of high humidity of 90% RH at 35° C., the charge quantity of the toner was −1.2 μC/g and the image density of the obtained images was as low as 0.43, and the obtained images were unclear with fogging.

EXAMPLE 23

The following components were mixed in a Henschel mixer and kneaded for about 30 minutes in a roll mill which was maintained at 130° to 140° C.

| | Parts by Weight |
|---|---|
| Polyester B (prepared in Preparation Example 1-2) | 100 |
| Carbon black "#44" (Trademark) made by Mitsubishi Carbon Co. | 10 |
| Fluorine-containing quaternary ammonium salt (15) | 1.5 |
| Metal-containing azo dye "Aizen Spilon Black TRH" (Trademark), made by Hodogaya Chemical Co., Ltd. | 2 |

The thus obtained mixture was cooled to room temperature, pulverized and classified, so that a black toner with a particle diameter of 5 to 20 μm was obtained.

100 parts by weight of the above prepared toner and 0.3 parts by weight of the hydrophobic colloidal silica were thoroughly mixed in a speed kneader ball mill.

2.5 parts by weight of the above prepared toner and 97.5 parts by weight of the carrier A which was prepared in Preparation Example 2-1 in a ball mill, whereby a two-component type developer No. 23 according to the present invention was obtained.

The thus obtained developer No. 23 according to the present invention was subjected to the same image formation test as in Example 10. The initial images obtained by the above test were clear. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

EXAMPLE 24

The following components were mixed in a Henschel mixer and kneaded for about 30 minutes in a roll mill which was maintained at 130° to 140° C.

| | Parts by Weight |
|---|---|
| Polyester A (prepared in Preparation Example 1-1) | 100 |
| Low-molecular-weight polypropylene | 5 |
| Carbon black "#44" (Trademark) made by Mitsubishi Carbon Co. | 10 |
| Fluorine-containing quaternary ammonium salt (16) | 1.5 |
| Metal-containing azo dye "Bontron S-32" (Trademark) made by Orient Chemical Industries, Ltd. | 0.5 |

The thus obtained mixture was cooled to room temperature, pulverized and classifed, so that a black toner with a particle diameter of 5 to 20 μm was obtained.

3.5 parts by weight of the above prepared toner and 96.5 parts by weight of the carrier C which was prepared in Preparation Example 2-3 in a ball mill, whereby a two-component type developer No. 24 according to the present invention was obtained.

The thus obtained developer No. 24 according to the present invention was subjected to the same image formation test as in Example 10. The initial images obtained by the above test were clear. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

COMPARATIVE EXAMPLE 8

The procedure for preparation of the two-component type developer No. 23 in Example 23 was repeated except that the fluorine-containing quaternary ammonium salt (15) was replaced by a commercially available zinc salt of salicylic acid "E-84" (Trademark), made by Orient Chemical Industries, Ltd., so that a comparative one-component type developer No. 8 was obtained.

The thus obtained comparative developer No. 8 was subjected to the same image formation test as in Example 10. The images obtained by the above test at ordinary humidity were sharp. Under the conditions of high humidity of 90% RH at 35° C., the image density of the obtained images was as low as 0.82, and the obtained images were unclear with fogging.

The charge quantity of the toner at ordinary humidity, measured by the blow-off method, was −10.3 μC/g. Under the conditions of high humidity of 90% RH at 35° C., the charge quantity of the toner decreased to −5.2 μC/g.

EXAMPLE 25

The following components were mixed in a Henschel mixer and kneaded for about 30 minutes in a roll mill which was maintained at 130° to 140° C.

| | Parts by Weight |
|---|---|
| Polyester C (prepared in Preparation Example 1-3) | 95 |
| Carnauba wax free from free fatty acid "NA-X-02" (Trademark) made by Noda Wax Co., Ltd. | 5 |
| Carbon black "#44" (Trademark) made by Mitsubishi Carbon Co. | 10 |
| Fluorine-containing quaternary ammonium salt (21) | 2 |
| Metal-containing azo dye "Bontron S-34" (Trademark) made by Orient Chemical Industries, Ltd. | 1.5 |

The thus obtained mixture was cooled to room temperature, pulverized and classifed, so that a black toner with a particle diameter of 5 to 25 μm was obtained.

3.0 parts by weight of the above prepared toner and 97.0 parts by weight of the carrier D which was prepared in Preparation Example 2-4 in a ball mill, whereby a two-component type developer No. 25 according to the present invention was obtained.

The thus obtained developer No. 25 according to the present invention was subjected to the same image formation test as in Example 10. The initial images obtained by the above test were clear. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

EXAMPLE 26

The following components were mixed in a Henschel mixer and kneaded for about 30 minutes in a roll mill which was maintained at 130° to 140° C.

| | Parts by Weight |
|---|---|
| Polyester D (prepared in Preparation Example 1-4) | 100 |
| Carbon black "#44" (Trademark) made by Mitsubishi Carbon Co. | 10 |
| Fluorine-containing quaternary ammonium salt (21) | 0.5 |
| Metal-containing azo dye "Spilon Black T-77" (Trademark), made by Hodogaya Chemical Co., Ltd. | 2.5 |

The thus obtained mixture was cooled to room temperature, pulverized and classified, so that a black toner with a particle diameter of 5 to 20 μm was obtained.

2.5 parts by weight of the above prepared toner and 97.5 parts by weight of the carrier A which was prepared in Preparation Example 2-1 in a ball mill, whereby a two-component type developer No. 26 according to the present invention was obtained.

The thus obtained developer No. 26 according to the present invention was subjected to the same image formation test as in Example 10. The initial images obtained by the above test were clear. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

EXAMPLE 27

The following components were mixed in a Henschel mixer and kneaded for about 30 minutes in a roll mill which was maintained at 130° to 140° C.

| | Parts by Weight |
|---|---|
| Polyester J (prepared in Preparation Example 1-9) | 100 |
| Carbon black "#44" (Trademark) made by Mitsubishi Carbon Co. | 10 |
| Fluorine-containing quaternary ammonium salt (1) | 1 |
| Metal-containing azo dye "Bontron S-34" (Trademark) made by Orient Chemical Industries, Ltd. | 2 |

The thus obtained mixture was cooled to room temperature, pulverized and classifed, so that a black toner with a particle diameter of 5 to 20 μm was obtained.

2.5 parts by weight of the above prepared toner and 97.5 parts by weight of the carrier A which was prepared in Preparation Example 2-1 in a ball mill, whereby a two-component type developer No. 27 according to the present invention was obtained.

The thus obtained developer No. 27 according to the present invention was subjected to the same image formation test as in Example 10. The initial images obtained by the above test were clear. Even after 100,000 copies were made, the obtained images were still excellent in quality.

The preservability of the toner images in the polyvinyl chloride mats were evaluated in the same manner as in Example 10. The toner images did not adhere to the polyvinyl chloride mats during the storage, and showed excellent preservability in the polyvinyl chloride mats.

COMPARATIVE EXAMPLE 9

The procedure for preparation of the two-component type developer No. 27 in Example 27 was repeated except that the fluorine-containing quaternary ammonium salt (1) was not used and that the amount of the metal-containing azo dye "Bontron S-34" (Trademark) made by Orient Chemical Industries, Ltd., used in Example 27 was changed to 4 parts by weight, so that a comparative two-component type developer No. 9 was obtained.

The thus obtained comparative developer No. 9 was subjected to the same image formation test as in Example 10. The initial images obtained by the above test were clear without fogging. After 10,000 copies were made, the obtained images became unclear with fogging.

The initial charge quantity of the toner, measured by the blow-off method, was −13.2 μC/g. After the making of 10,000 copies, the charge quantity of the toner decreased to −4.5 μC/g.

In addition, under the conditions of high humidity of 90% RH at 35° C., the charge quantity of the toner was −1.4 μC/g and the image density of the obtained images was as low as 0.39, and the obtained images were unclear with fogging.

EXAMPLE 28

The following components were mixed in a Henschel mixer and kneaded for about 30 minutes in a roll mill which was maintained at 130° to 140° C.

| | Parts by Weight |
|---|---|
| Polyester K (prepared in Preparation Example 1-10) | 100 |
| C.I.Pigment Red 15 | 5 |
| C.I.Pigment Red 48 | 3 |
| Fluorine-containing quaternary ammonium salt (15) | 2.5 |
| Metal-containing azo dye "Spilon Black TRH" (Trademark), made by Hodogaya Chemical Co., Ltd. | 1 |

The thus obtained mixture was cooled to room temperature, pulverized and classifed, so that a red toner with a particle diameter of 5 to 20 μm was obtained.

100 parts by weight of the above prepared toner and 0.4 parts by weight of the hydrophobic colloidal silica were thoroughly mixed in a speed kneader ball mill.

2.5 parts by weight of the above prepared toner and 97.5 parts by weight of the carrier A which was prepared in Preparation Example 2-1 in a ball mill, whereby a two-component type developer No. 28 according to the present invention was obtained.

The thus obtained developer No. 28 according to the present invention was subjected to the same image formation test as in Example 10. The initial images obtained by the above test were clear red. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

EXAMPLE 29

The following components were mixed in a Henschel mixer and kneaded for about 30 minutes in a roll mill which was maintained at 130° to 140° C.

| | Parts by Weight |
|---|---|
| Polyester J (prepared in Preparation Example 1-9) | 100 |
| Low-molecular-weight polypropylene | 5 |
| C.I.Pigment Blue 15 | 5 |
| C.I.Pigment Yellow 17 | 5 |
| Fluorine-containing quaternary ammonium salt (2) | 1.5 |
| Metal-containing azo dye "Bontron S-34" (Trademark) made by Orient Chemical Industries, Ltd. | 2 |

The thus obtained mixture was cooled to room temperature, pulverized and classifed, so that a green toner with a particle diameter of 5 to 20 μm was obtained.

3.5 parts by weight of the above prepared toner and 96.5 parts by weight of the carrier C which was prepared in Preparation Example 2-3 in a ball mill, whereby a two-component type developer No. 29 according to the present invention was obtained.

The thus obtained developer No. 29 according to the present invention was subjected to the same image formation test as in Example 10. The initial images obtained by the above test were clear green. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

COMPARATIVE EXAMPLE 10

The procedure for preparation of the two-component type developer No. 28 in Example 28 was repeated except that the fluorine-containing quaternary ammonium salt (15) was replaced by a commercially available zinc salt of salicylic acid "E-84" (Trademark), made by Orient Chemical Industries, Ltd., so that a comparative one-component type developer No. 10 was obtained.

The thus obtained comparative developer No. 10 was subjected to the same image formation test as in Example 10. The images obtained by the above test at ordinary humidity were sharp. Under the conditions of high humidity of 90% RH at 35° C., the image density of the obtained images was as low as 0.66, and the obtained images were unclear with fogging.

The charge quantity of the toner at ordinary humidity, measured by the blow-off method, was −18.1 μC/g. Under the conditions of high humidity of 90% RH at 35° C., the charge quantity of the toner decreased to −4.3 μC/g.

EXAMPLE 30

The following components were mixed in a Henschel mixer and kneaded for about 30 minutes in a roll mill which was maintained at 130° to 140° C.

| | Parts by Weight |
|---|---|
| Polyester L (prepared in Preparation Example 1-11) | 95 |
| Carnauba wax free from free fatty acid "NA-X-02" (Trademark) made by Noda Wax Co., Ltd. | 5 |
| Carbon black "#44" (Trademark) made by Mitsubishi Carbon Co. | 10 |
| Fluorine-containing quaternary ammonium salt (16) | 1 |
| Metal-containing azo dye "Bontron S-44" Trademark) made by Orient Chemical Industries, Ltd. | 2.5 |

The thus obtained mixture was cooled to room temperature, pulverized and classifed, so that a black toner with a particle diameter of 5 to 25 μm was obtained.

3.0 parts by weight of the above prepared toner and 97.0 parts by weight of the carrier D which was prepared in Preparation Example 2-4 in a ball mill, whereby a two-component type developer No. 30 according to the present invention was obtained.

The thus obtained developer No. 30 according to the present invention was subjected to the same image formation test as in Example 10. The initial images obtained by the above test were clear. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

EXAMPLE 31

The following components were mixed in a Henschel mixer and kneaded for about 30 minutes in a roll mill which was maintained at 130° to 140° C.

| | Parts by Weight |
|---|---|
| Polyester M (prepared in Preparation Example 1-12) | 100 |
| Carbon black "#44" (Trademark) made by Mitsubishi Carbon Co. | 10 |
| Fluorine-containing quaternary ammonium salt (21) | 2 |
| Metal-containing azo dye "Bontron S-34" (Trademark) made by Orient Chemical Industries, Ltd. | 1.5 |

The thus obtained mixture was cooled to room temperature, pulverized and classifed, so that a black toner with a particle diameter of 5 to 20 μm was obtained.

2.5 parts by weight of the above prepared toner and 97.5 parts by weight of the carrier A which was prepared in Preparation Example 2-1 in a ball mill, whereby a two-component type developer No. 31 according to the present invention was obtained.

The thus obtained developer No. 31 according to the present invention was subjected to the same image formation test as in Example 10. The initial images obtained by the above test were clear. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

EXAMPLE 32

The following components were mixed in a Henschel mixer and kneaded for about 30 minutes in a roll mill which was maintained at 130° to 140° C.

| | Parts by Weight |
|---|---|
| Polyester J (prepared in Preparation Example 1-9) | 95 |
| Low-molecular-weight polypropylene | 5 |
| C.I.Pigment Blue 15 | 5 |
| Fluorine-containing quaternary ammonium salt (26) | 1 |
| Metal-containing azo dye "Spilon Black TRH" (Trademark), made by Hodogaya Chemical Co., Ltd. | 2 |

The thus obtained mixture was cooled to room temperature, pulverized and classifed, so that a blue toner with a particle diameter of 5 to 20 μm was obtained.

2.5 parts by weight of the above prepared toner and 97.5 parts by weight of the carrier B which was prepared in Preparation Example 2-2 in a ball mill, whereby a two-component type developer No. 32 according to the present invention was obtained.

The thus obtained developer No. 32 according to the present invention was subjected to the same image formation test as in Example 10. The initial images obtained by the above test were clear blue. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

EXAMPLE 33

The following components were mixed in a Henschel mixer and kneaded for about 30 minutes in a roll mill which was maintained at 130° to 140° C.

| | Parts by Weight |
|---|---|
| Polyester A (prepared in Preparation Example 1-1) | 80 |
| Styrene-n-butylmethacrylate copolymer | 20 |
| C.I.Pigment Blue 15 | 5 |
| Fluorine-containing quaternary ammonium salt (1) | 2 |

The thus obtained mixture was cooled to room temperature, pulverized and classifed, so that a blue toner with a particle diameter of 5 to 20 μm was obtained.

2.5 parts by weight of the above prepared toner and 97.5 parts by weight of the carrier A which was prepared in Preparation Example 2-1 in a ball mill, whereby a two-component type developer No. 33 according to the present invention was obtained.

The thus obtained developer No. 33 according to the present invention was subjected to the same image formation test as in Example 10. The initial images obtained by the above test were clear blue. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

EXAMPLE 34

The following components were mixed in a Henschel mixer and kneaded for about 30 minutes in a roll mill which was maintained at 130° to 140° C.

| | Parts by Weight |
|---|---|
| Polyester A (prepared in Preparation Example 1-1) | 75 |
| Styrene-n-butylmethacrylate copolymer | 25 |
| Carbon black "#44" (Trademark) made by Mitsubishi Carbon Co. | 9 |
| Fluorine-containing quaternary ammonium salt (1) | 1 |
| Metal-containing azo dye | 1.5 |

-continued

| | Parts by Weight |
|---|---|
| "Bontron S-34" (Trademark) made by Orient Chemical Industries, Ltd. | |

The thus obtained mixture was cooled to room temperature, pulverized and classifed, so that a black toner with a particle diameter of 5 to 20 μm was obtained.

3 parts by weight of the above prepared toner and 97 parts by weight of the carrier A which was prepared in Preparation Example 2-1 in a ball mill, whereby a two-component type developer No. 34 according to the present invention was obtained.

The thus obtained developer No. 34 according to the present invention was subjected to the same image formation test as in Example 10. The initial images obtained by the above test were clear. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

COMPARATIVE EXAMPLE 11

The procedure for preparation of the two-component type developer No. 34 in Example 34 was repeated except that the fluorine-containing quaternary ammonium salt (1) was not used and that the amount of the metal-containing azo dye "Bontron S-34" (Trademark) made by Orient Chemical Industries, Ltd., used in Example 34 was changed to 2.5 parts by weight, so that a comparative two-component type developer No. 11 was obtained.

The thus obtained comparative developer No. 11 was subjected to the same image formation test as in Example 10. The initial images obtained by the above test were clear without fogging. After 10,000 copies were made, the obtained images became unclear with fogging.

The initial charge quantity of the toner, measured by the blow-off method, was −15.2 μC/g. After the making of 10,000 copies, the charge quantity of the toner decreased to −4.2 μC/g.

In addition, under the conditions of high humidity of 90% RH at 35° C., the charge quantity of the toner was −2.3 μC/g and the image density of the obtained images was as low as 0.44, and the obtained images were unclear with fogging.

Moreover, the procedure for preparation of the two-component type developer No. 34 in Example 34 was repeated except that the amount of the polyester resin A was changed to 55 parts by weight, and that the amount of styrene-n-methylmethacrylate copolymer was changed to 45 parts by weight, so that a comparative two-component type developer was obtained.

The thus obtained comparative developer was subjected to the same image formation test as in Example 10. The initial images obtained by the above test were clear. Even after 100,000 copies were made, the obtained images were still excellent in quality.

The initial charge quantity of the toner, measured by the blow-off method, was −19.2 μC/g. After the making of 100,000 copies, the charge quantity of the toner was −17.8 μC/g, which was almost the same as the initial charge quantity of the toner.

In addition, under the high humidity of 90% RH at 35° C., the charge quantity of the toner was −17.2 μC/g, and under the low humidity of 15% RH at 10° C., the charge quantity of the toner was −20.2 μC/g.

The preservability of the toner images in the polyvinyl chloride mats was evaluated in the same manner as in Example 10. The toner images adhered to the polyvinyl chloride mats during the storage, and the preservability in the polyvinyl chloride mats was unsatisfactory.

EXAMPLE 35

The following components were mixed in a Henschel mixer and kneaded for about 30 minutes in a roll mill which was maintained at 130° to 140° C.

| | Parts by Weight |
|---|---|
| Polyester B (prepared in Preparation Example 1-2) | 90 |
| Styrene-n-butyl methacrylate copolymer | 10 |
| Carbon black "#44" (Trademark) made by Mitsubishi Carbon Co. | 10 |
| Fluorine-containing quaternary ammonium salt (15) | 1.5 |
| Metal-containing azo dye "Spilon Black TRH" (Trademark) made by Hodogaya Chemical Co., Ltd. | 1 |

The thus obtained mixture was cooled to room temperature, pulverized and classifed, so that a black toner with a particle diameter of 5 to 20 μm was obtained.

100 parts by weight of the above prepared toner and 0.4 parts by weight of the hydrophobic colloidal silica were thoroughly mixed in a speed kneader ball mill.

2.5 parts by weight of the above prepared toner and 97.5 parts by weight of the carrier A which was prepared in Preparation Example 2-1 in a ball mill, whereby a two-component type developer No. 35 according to the present invention was obtained.

The thus obtained developer No. 35 according to the present invention was subjected to the same image formation test as in Example 10. The initial images obtained by the above test were clear. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

EXAMPLE 36

The following components were mixed in a Henschel mixer and kneaded for about 30 minutes in a roll mill which was maintained at 130° to 140° C.

| | Parts by Weight |
|---|---|
| Polyester A (prepared in Preparation Example 1-1) | 85 |
| Styrene-n-butyl methacrylate copolymer | 15 |
| Low-molecular-weight polypropylene | 6 |
| Carbon black "#44" (Trademark) made by Mitsubishi Carbon Co. | 10 |
| Fluorine-containing quaternary ammonium salt (2) | 1.5 |
| Metal-containing azo dye "Bontron S-34" (Trademark) made by Orient Chemical Industries, Ltd. | 2 |

The thus obtained mixture was cooled to room temperature, pulverized and classifed, so that a black toner with a particle diameter of 5 to 20 μm was obtained.

3.5 parts by weight of the above prepared toner and 96.5 parts by weight of the carrier C which was prepared in Preparation Example 2-3 in a ball mill, whereby a two-component type developer No. 36 according to the present invention was obtained.

The thus obtained developer No. 36 according to the present invention was subjected to the same image formation test as in Example 10. The initial images obtained by the above test were clear. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

COMPARATIVE EXAMPLE 12

The procedure for preparation of the two-component type developer No. 34 in Example 34 was repeated except that the fluorine-containing quaternary ammonium salt (15) was replaced by a commercially available zinc salt of salicylic acid "E-84" (Trademark), made by Orient Chemical Industries, Ltd., so that a comparative one-component type developer No. 12 was obtained.

The thus obtained comparative developer No. 12 was subjected to the same image formation test as in Example 10. The images obtained by the above test at ordinary humidity were sharp. Under the conditions of high humidity of 90% RH at 35° C., the image density of the obtained images was as low as 0.66, and the obtained images were unclear with fogging.

The charge quantity of the toner at ordinary humidity, measured by the blow-off method, was −18.1 μC/g. Under the conditions of high humidity of 90% RH at 35° C., the charge quantity of the toner decreased to −4.3 μC/g.

EXAMPLE 37

The following components were mixed in a Henschel mixer and kneaded for about 30 minutes in a roll mill which was maintained at 130° to 140° C.

| | Parts by Weight |
|---|---|
| Polyester C (prepared in Preparation Example 1-3) | 65 |
| Styrene-n-butylmethacrylate copolymer | 35 |
| Carnauba wax free from free fatty acid "NA-X-02" (Trademark) made by Noda Wax Co., Ltd. | 5 |
| Carbon black "#44" (Trademark) made by | 10 |

-continued

| | Parts by Weight |
|---|---|
| Mitsubishi Carbon Co. | |
| Fluorine-containing quaternary ammonium salt (16) | 1 |
| Metal-containing azo dye "Bontron S-44" (Trademark) made by Orient Chemical Industries, Ltd. | 2.5 |

The thus obtained mixture was cooled to room temperature, pulverized and classified, so that a black toner with a particle diameter of 5 to 25 μm was obtained.

3.0 parts by weight of the above prepared toner and 97.0 parts by weight of the carrier D which was prepared in Preparation Example 2-4 in a ball mill, whereby a two-component type developer No. 37 according to the present invention was obtained.

The thus obtained developer No. 37 according to the present invention was subjected to the same image formation test as in Example 10. The initial images obtained by the above test were clear. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

EXAMPLE 38

The following components were mixed in a Henschel mixer and kneaded for about 30 minutes in a roll mill which was maintained at 130° to 140° C.

| | Parts by Weight |
|---|---|
| Polyester D (prepared in Preparation Example 1-4) | 75 |
| Styrene-n-butylmethacrylate copolymer | 25 |
| Carbon black "#44" (Trademark) made by Mitsubishi Carbon Co. | 10 |
| Fluorine-containing quaternary ammonium salt (21) | 0.5 |
| Metal-containing azo dye "Bontron S-34" (Trademark) made by Orient Chemical Industries, Ltd. | 2 |

The thus obtained mixture was cooled to room temperature, pulverized and classifed, so that a black toner with a particle diameter of 5 to 20 μm was obtained.

2.5 parts by weight of the above prepared toner and 97.5 parts by weight of the carrier A which was prepared in Preparation Example 2-1 in a ball mill, whereby a two-component type developer No. 38 according to the present invention was obtained.

The thus obtained developer No. 38 according to the present invention was subjected to the same image formation test as in Example 10. The initial images obtained by the above test were clear. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

EXAMPLE 39

The following components were mixed in a Henschel mixer and kneaded for about 30 minutes in a roll mill which was maintained at 130° to 140° C.

| | Parts by Weight |
|---|---|
| Polyester B (prepared in Preparation Example 1-2) | 85 |
| Styrene-n-butyl methacrylate copolymer | 10 |
| Low-molecular-weight polypropylene | 5 |
| C.I.Pigment Red 57 | 5 |
| C.I.Pigment Red 48 | 3 |
| Fluorine-containing quaternary ammonium salt (23) | 1.5 |

The thus obtained mixture was cooled to room temperature, pulverized and classifed, so that a red toner with a particle diameter of 5 to 25 μm was obtained.

2.5 parts by weight of the above prepared toner and 97.5 parts by weight of the carrier A which was prepared in Preparation Example 2-1 in a ball mill, whereby a two-component type developer No. 39 according to the present invention was obtained.

The thus obtained developer No. 39 according to the present invention was subjected to the same image formation test as in Example 10. The initial images obtained by the above test were clear red. Even after 100,000 copies were made, the obtained images were still excellent in quality. The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

EXAMPLE 40

The following components were mixed in a Henschel mixer and kneaded for about 30 minutes in a roll mill which was maintained at 130° to 140° C.

| | Parts by Weight |
|---|---|
| Polyester J (prepared in Preparation Example 1-9) | 80 |
| Styrene-n-butylmethacrylate copolymer | 20 |
| Carbon black "#44" (Trademark) made by Mitsubishi Carbon Co. | 8 |
| Fluorine-containing quaternary ammonium salt (1) | 3.5 |
| Metal-containing azo dye "Spilon Black TRH" (Trademark), made by Hodogaya Chemical Co., Ltd. | 1 |

The thus obtained mixture was cooled to room temperature, pulverized and classifed, so that a black toner with a particle diameter of 5 to 20 μm was obtained.

2.5 parts by weight of the above prepared toner and 97.5 parts by weight of the carrier A which was prepared in Preparation Example 2-1 in a ball mill, whereby a two-component type developer No. 40 according to the present invention was obtained.

The thus obtained developer No. 40 according to the present invention was subjected to the same image formation test as in Example 10. The initial images obtained by the above test were clear. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

COMPARATIVE EXAMPLE 13

The procedure for preparation of the two-component type developer No. 40 in Example 40 was repeated except that the fluorine-containing quaternary ammonium salt (1) was not used and that the amount of the metal-containing azo dye "Spilon Black TRH" (Trademark), made by Hodogaya Chemical Co., Ltd., used in Example 40 was changed to 4 parts by weight, so that a comparative two-component type developer No. 13 was obtained.

The thus obtained comparative developer No. 13 was subjected to the same image formation test as in Example 10. The initial images obtained by the above test were clear without fogging. After 10,000 copies were made, the obtained images became unclear with fogging.

The initial charge quantity of the toner, measured by the blow-off method, was $-14.2\ \mu C/g$. After the making of 10,000 copies, the charge quantity of the toner decreased to $-3.5\ \mu C/g$.

In addition, under the conditions of high humidity of 90% RH at 35° C., the charge quantity of the toner was $-2.2\ \mu C/g$ and the image density of the obtained images was as low as 0.38, and the obtained images were unclear with fogging.

EXAMPLE 41

The following components were mixed in a Henschel mixer and kneaded for about 30 minutes in a roll mill which was maintained at 130° to 140° C.

| | Parts by Weight |
|---|---|
| Polyester K (prepared in Preparation Example 1-10) | 90 |
| Styrene - n-butyl methacrylate copolymer | 10 |
| Carbon black "#44" (Trademark) made by Mitsubishi Carbon Co. | 7 |
| Fluorine-containing quaternary ammonium salt (15) | 3.5 |
| Metal-containing azo dye "Spilon Black TRH" (Trademark), made by Hodogaya Chemical Co., Ltd. | 1 |

The thus obtained mixture was cooled to room temperature, pulverized and classifed, so that a black toner with a particle diameter of 5 to 20 μm was obtained.

100 parts by weight of the above prepared toner and 0.4 parts by weight of the hydrophobic colloidal silica were thoroughly mixed in a speed kneader ball mill.

2.5 parts by weight of the above prepared toner and 97.5 parts by weight of the carrier A which was prepared in Preparation Example 2-1 in a ball mill, whereby a two-component type developer No. 41 according to the present invention was obtained.

The thus obtained developer No. 41 according to the present invention was subjected to the same image formation test as in Example 10. The initial images obtained by the above test were clear. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

EXAMPLE 42

The following components were mixed in a Henschel mixer and kneaded for about 30 minutes in a roll mill which was maintained at 130° to 140° C.

| | Parts by Weight |
|---|---|
| Polyester J (prepared in Preparation Example 1-9) | 85 |
| Styrene-n-butyl methacrylate copolymer | 15 |
| Low-molecular-weight polypropylene | 6 |
| Carbon black "#44" (Trademark) made by Mitsubishi Carbon Co. | 10 |
| Fluorine-containing quaternary ammonium salt (2) | 1.5 |
| Metal-containing azo dye "Bontron S-34" (Trademark) made by Orient Chemical Industries, Ltd. | 2 |

The thus obtained mixture was cooled to room temperature, pulverized and classified, so that a black toner with a particle diameter of 5 to 20 μm was obtained.

3.5 parts by weight of the above prepared toner and 96.5 parts by weight of the carrier C which was prepared in Preparation Example 2-3 in a ball mill, whereby a two-component type developer No. 42 according to the present invention was obtained.

The thus obtained developer No. 42 according to the present invention was subjected to the same image formation test as in Example 10. The initial images obtained by the above test were clear. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

COMPARATIVE EXAMPLE 14

The procedure for preparation of the two-component type developer No. 41 in Example 41 was repeated except that the fluorine-containing quaternary ammonium salt (15) was replaced by a commercially available zinc salt of salicylic acid "E-84" (Trademark), made by Orient Chemical Industries, Ltd., so that a comparative one-component type developer No. 14 was obtained.

The thus obtained comparative developer No. 14 was subjected to the same image formation test as in Example 10. The images obtained by the above test at ordinary humidity were sharp. Under the conditions of high humidity of 90% RH at 35° C., the image density of the obtained images was as low as 0.66, and the obtained images were unclear with fogging.

The charge quantity of the toner at ordinary humidity, measured by the blow-off method, was −18.1 μC/g. Under the conditions of high humidity of 90% RH at 35° C., the charge quantity of the toner decreased to −4.3 μC/g.

EXAMPLE 43

The following components were mixed in a Henschel mixer and kneaded for about 30 minutes in a roll mill which was maintained at 130° to 140° C.

| | Parts by Weight |
|---|---|
| Polyester L (prepared in Preparation Example 1-11) | 85 |
| Styrene-n-butylmethacrylate copolymer | 15 |
| Carnauba wax free from free fatty acid "NA-X-02" (Trademark) made by Noda Wax Co., Ltd. | 5 |
| Carbon black "#44" (Trademark) made by Mitsubishi Carbon Co. | 6.5 |
| Fluorine-containing quaternary ammonium salt (16) | 1 |
| Metal-containing azo dye "Bontron S-44" (Trademark) made by Orient Chemical Industries, Ltd. | 2.5 |

The thus obtained mixture was cooled to room temperature, pulverized and classifed, so that a black toner with a particle diameter of 5 to 25 μm was obtained.

3.0 parts by weight of the above prepared toner and 97.0 parts by weight of the carrier D which was prepared in Preparation Example 2-4 in a ball mill, whereby a two-component type developer No. 43 according to the present invention was obtained.

The thus obtained developer No. 43 according to the present invention was subjected to the same image formation test as in Example 10. The initial images obtained by the above test were clear. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

EXAMPLE 44

The following components were mixed in a Henschel mixer and kneaded for about 30 minutes in a roll mill which was maintained at 130° to 140° C.

| | Parts by Weight |
|---|---|
| Polyester M (prepared in Preparation Example 1-12) | 75 |
| Styrene-n-butylmethacrylate copolymer | 25 |
| Carbon black "#44" (Trademark) made by Mitsubishi Carbon Co. | 10 |
| Fluorine-containing quaternary ammonium salt (21) | 2 |
| Metal-containing azo dye "Bontron S-34" (Trademark) made by Orient Chemical Industries, Ltd. | 1.5 |

The thus obtained mixture was cooled to room temperature, pulverized and classifed, so that a black toner with a particle diameter of 5 to 20 μm was obtained.

2.5 parts by weight of the above prepared toner and 97.5 parts by weight of the carrier A which was prepared in Preparation Example 2-1 in a ball mill, whereby a two-component type developer No. 44 according to the present invention was obtained.

The thus obtained developer No. 44 according to the present invention was subjected to the same image formation test as in Example 10. The initial images obtained by the above test were clear. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

EXAMPLE 45

The following components were mixed in a Henschel mixer and kneaded for about 30 minutes in a roll mill which was maintained at 130° to 140° C.

| | Parts by Weight |
|---|---|
| Polyester J (prepared in Preparation Example 1-9) | 85 |
| Styrene-n-butyl methacrylate copolymer | 10 |
| Low-molecular-weight polypropylene | 5 |
| C.I.Pigment Blue 15 | 5 |
| Fluorine-containing quaternary ammonium salt (26) | 2.1 |
| Metal-containing azo dye "Spilon Black TRH" (Trademark), made by Hodogaya Chemical Co., Ltd. | 2 |

The thus obtained mixture was cooled to room temperature, pulverized and classifed, so that a blue toner with a particle diameter of 5 to 20 μm was obtained.

2.5 parts by weight of the above prepared toner and 97.5 parts by weight of the carrier B which was prepared in Preparation Example 2-2 in a ball mill, whereby a two-component component type developer No. 45 according to the present invention was obtained.

The thus obtained developer No. 45 according to the present invention was subjected to the same image formation test as in Example 10. The initial images obtained by the above test were clear red. Even after 100,000 copies were made, the obtained images were still excellent in quality.

The preservability of the toner images in the polyvinyl chloride mats was evaluated in the same manner as in Example 10. The toner images did not adhere to the polyvinyl chloride mats during the storage, and showed excellent preservability in the polyvinyl chloride mats.

TABLE 3

| Example No. | Charge Quantity (μC/g) Initial stage | After 100,000 copies | 35° C., 90% RH | 10° C., 15% RH |
|---|---|---|---|---|
| 10 | −20.5 | −19.6 | −18.7 | −22.3 |
| 11 | −22.8 | −21.4 | −20.7 | −24.1 |
| 12 | −19.3 | −18.6 | −17.1 | −21.4 |
| 13 | −20.6 | −19.8 | −19.1 | −21.8 |
| 14 | −18.2 | −17.3 | −17.3 | −20.3 |
| 15 | −22.5 | −21.8 | −19.7 | −23.3 |
| 16 | −18.4 | −17.3 | −18.1 | −21.8 |
| 17 | −24.5 | −22.4 | −21.3 | −25.7 |
| 18 | −19.3 | −18.6 | −17.1 | −21.4 |
| 19 | −19.0 | −17.8 | −19.1 | −21.8 |
| 20 | −19.6 | −17.9 | −17.1 | −22.0 |
| 21 | −23.8 | −21.4 | −19.9 | −22.3 |
| 22 | −24.5 | −23.4 | −22.9 | −26.1 |
| 23 | −21.8 | −20.3 | −19.2 | −23.8 |
| 24 | −21.7 | −20.2 | −22.1 | −19.3 |
| 25 | −23.6 | −22.1 | −20.5 | −24.9 |
| 26 | −17.8 | −16.5 | −17.1 | −20.6 |
| 27 | −23.0 | −19.9 | −18.1 | −23.0 |
| 28 | −25.0 | −24.6 | −23.8 | −24.9 |
| 29 | −18.6 | −17.1 | −16.9 | −19.9 |
| 30 | −21.2 | −20.6 | −19.1 | −21.1 |
| 31 | −18.4 | −16.0 | −16.1 | −18.4 |
| 32 | −21.3 | −20.8 | −19.1 | −22.5 |
| 33 | −23.5 | −22.6 | −24.4 | −23.3 |
| 34 | −22.0 | −21.1 | −20.8 | −22.9 |
| 35 | −25.4 | −24.1 | −25.0 | −24.9 |
| 36 | −18.6 | −17.1 | −16.9 | −19.9 |
| 37 | −20.2 | −19.6 | −19.2 | −21.5 |
| 38 | −18.1 | −17.6 | −16.7 | −19.5 |
| 39 | −17.8 | −17.1 | −16.9 | −20.5 |
| 40 | −22.1 | −19.7 | −21.1 | −23.4 |
| 41 | −25.4 | −24.1 | −25.0 | −24.9 |
| 42 | −18.6 | −17.1 | −16.9 | −19.9 |
| 43 | −21.2 | −20.6 | −19.1 | −21.1 |
| 44 | −18.4 | −16.0 | −16.1 | −18.4 |
| 45 | −21.3 | −20.8 | −19.1 | −22.5 |

As previously mentioned, since the negatively chargeable toner according to the present invention comprises a charge controlling agent which comprises a fluorine-containing quaternary ammonium salt of the formula (I), the triboelectricity with the negative polarity can stably be imparted to the toner. Accordingly, the image quality of the images obtained is excellent even after the continuous copying operation. In addition, the above charge controlling agent is highly dispersed in the binder resin, and has high environmental stability, with the result that the clear color images can be produced.

Moreover, when the above-mentioned fluorine-containing quaternary ammonium salt of the formula (I), serving as a charge controlling agent, is used in combination with a polyester resin, serving as a binder resin, the preservability in the polyvinyl chloride mats is excellent.

Furthermore, when the mixture of the above-mentioned fluorine-containing quaternary ammonium salt of the formula (I) and a metal-containing azo dye is used as the charge controlling agent, the negatively chargeability is further stabilized.

The above-mentioned fluorine-containing quaternary ammonium salt of the formula (I) can effectively improve the chargeability even when used together with a polyester resin or epoxy resin of which chargeability is not sufficient. Therefore, a color toner capable of producing clear color images and a toner capable of being fixed at low temperatures can be obtained.

What is claimed is:

1. A negatively chargeable toner for developing latent electrostatic images comprising (i) a binder resin, (ii) a coloring agent and (iii) a charge controlling agent which comprises a fluorine-containing quaternary ammonium salt of formula (I):

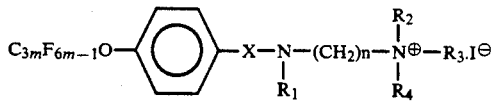

(I)

wherein X represents $-SO_2$ or $-CO$; $R_1$, $R_2$, $R_3$ and $R_4$ independently represent hydrogen, an alkyl group having 1 to 10 carbon atoms or an aryl group; m is an integer of 1 to 5; and n is an integer of 1 to 10.

2. The negatively chargeable toner as claimed in claim 1, wherein said fluorine-containing quaternary ammonium salt of formula (I) are selected from the group consisting of:

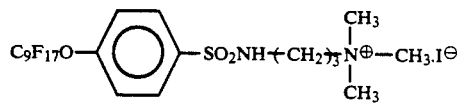

(1)

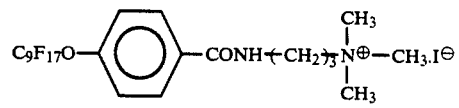

(2)

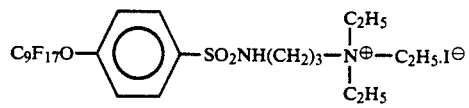

(3)

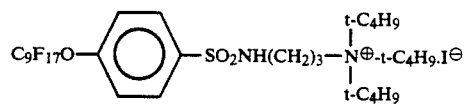

(4)

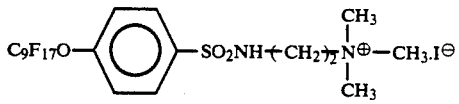

(5)

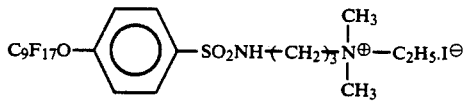

(6)

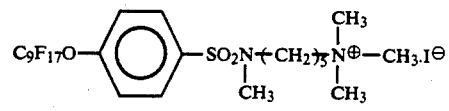

(7)

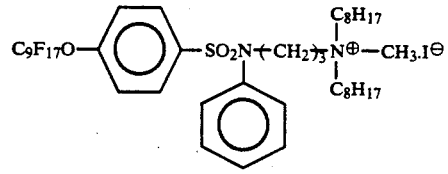

(8)

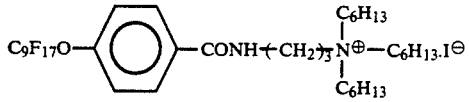

(9)

-continued (10)

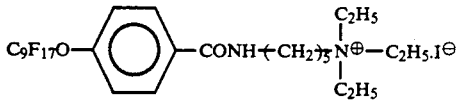

(11)

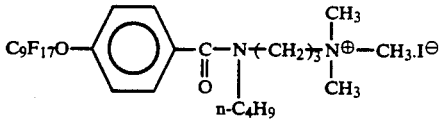

(12)

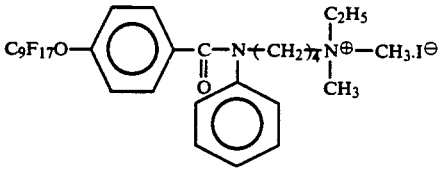

(13)

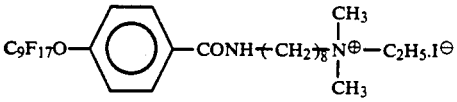

(14)

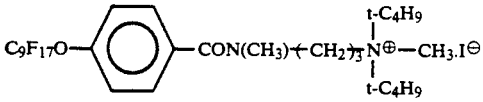

(15)

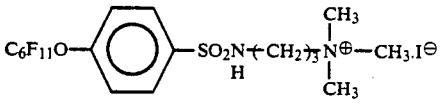

(16)

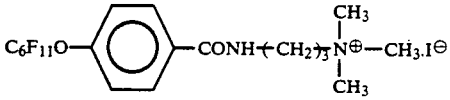

(17)

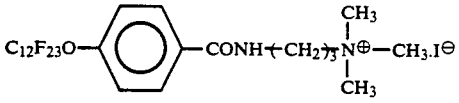

(18)

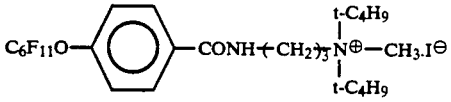

(19)

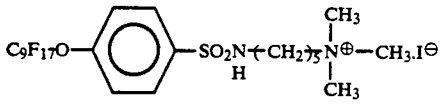

(20)

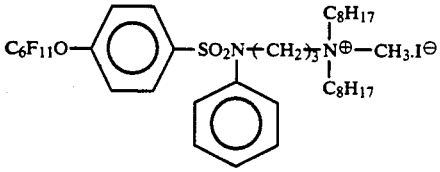

-continued (21)

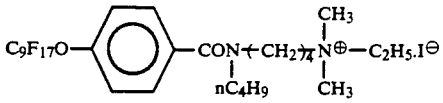

(22)

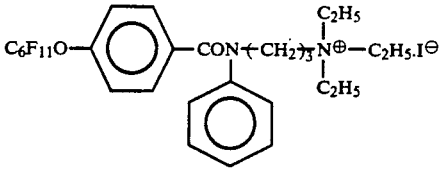

(23)

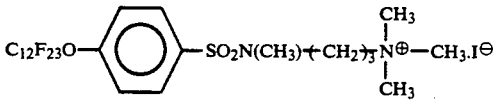

(24)

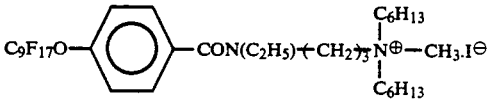

(25)

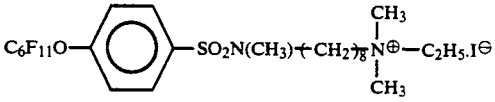

(26)

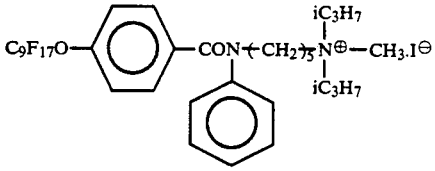

(27)

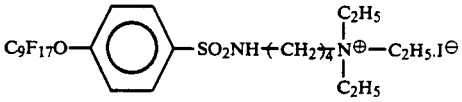

3. The negatively chargeable toner as claimed in claim 1, wherein the amount of said fluorine-containing quaternary ammonium salt is in the range of 0.1 to 20 parts by weight to 100 parts by weight of said binder resin.

4. The negatively chargeable toner as claimed in claim 1, wherein said charge controlling agent further comprises a metal-containing azo dye.

5. The negatively chargeable toner as claimed in claim 1, wherein said binder resin comprises a polyester resin.

6. The negatively chargeable toner as claimed in claim 1, further comprising a magnetic material.

7. The negatively chargeable toner as claimed in claim 6, wherein said magnetic material has a particle diameter of 0.1 to 2 μm.

8. The negatively chargeable toner as claimed in claim 6, wherein the amount of said magnetic material is in the range of about 20 to 200 parts by weight to 100 parts by weight of said binder resin.

9. The negatively chargeable toner as claimed in claim 1, further comprising carrier particles which are mixed with said toner to constitute a two-component type developer.

10. The negatively chargeable toner as claimed in claim 9, wherein said carrier particles are coated with electroconductive-particles-containing silicone resin.

* * * * *